US006502593B1

(12) United States Patent
Stafford

(10) Patent No.: US 6,502,593 B1
(45) Date of Patent: Jan. 7, 2003

(54) METHOD OF ERECTING A TENT

(75) Inventor: Robert M. Stafford, Weed, CA (US)

(73) Assignee: S & S Structures, Inc., Weed, CA (US)

( * ) Notice: Subject to any disclaimer, the term of this patent is extended or adjusted under 35 U.S.C. 154(b) by 0 days.

(21) Appl. No.: 09/855,279

(22) Filed: May 14, 2001

Related U.S. Application Data

(63) Continuation of application No. 09/778,610, filed on Feb. 7, 2001, now abandoned.
(60) Provisional application No. 60/181,742, filed on Feb. 11, 2000.

(51) Int. Cl.[7] ..... E04H 15/54
(52) U.S. Cl. ..... 135/115; 135/119; 135/121; 135/123; 52/222; 52/86; 52/63
(58) Field of Search ..... 52/222, 63, 86; 135/121, 123, 115, 119, 906, 907, 908

(56) References Cited

U.S. PATENT DOCUMENTS

| | | | | | |
|---|---|---|---|---|---|
| 645,890 | A | * | 3/1900 | Conrad | 135/90 |
| 4,033,367 | A | * | 7/1977 | Johnston | 135/96 |
| 4,593,710 | A | | 6/1986 | Stafford et al. | |
| 4,644,706 | A | | 2/1987 | Stafford et al. | |
| 4,837,990 | A | * | 6/1989 | Peleg | 52/63 |
| 5,146,722 | A | | 9/1992 | Stafford | |
| 5,269,106 | A | | 12/1993 | Stafford et al. | |
| 5,426,899 | A | * | 6/1995 | Jones | 52/63 |
| 5,487,242 | A | | 1/1996 | Stafford | |
| 5,546,972 | A | * | 8/1996 | Wardell | 135/129 |
| 5,565,234 | A | * | 10/1996 | Vermeulen | 52/63 |
| 5,784,842 | A | * | 7/1998 | Wackerbauer | 52/222 |
| 5,964,236 | A | * | 10/1999 | Berke | 135/90 |
| 5,974,740 | A | * | 11/1999 | Park | 135/119 |
| 6,003,269 | A | * | 12/1999 | McRee | 52/63 |
| 6,247,484 | B1 | * | 6/2001 | Thomas | 135/123 |
| 6,260,308 | B1 | * | 7/2001 | Looney | 52/63 |
| 6,266,932 | B1 | * | 7/2001 | Van Tassel | 52/86 |

FOREIGN PATENT DOCUMENTS

| | | | | |
|---|---|---|---|---|
| DE | 3243525 | * | 5/1984 | 52/63 |

* cited by examiner

*Primary Examiner*—Beth A. Stephan
(74) *Attorney, Agent, or Firm*—Knobbe Martens Olson & Bear, LLP

(57) ABSTRACT

In accordance with one aspect of the present invention, a method of erecting a tent comprising two or more beam assemblies is provided. Each of the beam assemblies comprises a roof portion and a pair of legs for supporting the roof portion. A number of base members are secured to the ground at predetermined locations. The roof portions are pivotally connected to the base members and rotated upwardly from the ground while maintaining the connection to the base members. A first side of each of the roof portions is disconnected from an associated one of the base members and raised above the base member. A first leg is connected to the first side. The first leg is then connected to the base member. A second side of each of the roof portions is disconnected from an associated one of the base members and raised above the base member. The second leg is connected to the second side. The second leg is then connected to the base member.

19 Claims, 44 Drawing Sheets

METHOD OF ERECTING A TENT

RELATED APPLICATIONS

This application is a continuation of U.S. application Ser. No. 09/778,610, filed Feb. 7, 2001, now abandoned, which claims priority to U.S. provisional application Ser. No. 60/181,742, filed Feb. 11, 2000.

FIELD OF THE INVENTION

The present invention relates to enclosures and, more particularly, to tent enclosures.

DESCRIPTION OF THE RELATED ART AND SUMMARY OF THE INVENTION

Fabric-covered structures are a relatively common form of semi-permanent shelter. Such structures typically can withstand moderate to severe weather conditions over extended periods of time. However, fabric-covered structures are generally relatively expensive. Specialized equipment and skilled workers are typically required to erect and disassemble the structures. Their components generally are relatively large and difficult to transport. Such structures thus are not suitable for short term rental for parties or other gatherings.

Fabric-covered frame tents are a popular form of temporary shelter. Such frame tents are typically relatively cheap and easy to construct in favorable weather conditions. They can generally be erected and disassembled by unskilled workers and without specialized equipment. Frame tents typically comprise a number of relatively small frame components that can easily be transported from one site to another. Such frame tents thus are well-suited for short term rental for parties and other gatherings.

Frame tents typically are constructed by first assembling the roof of the tent on the ground. The roof is then lifted so that legs can be installed to support the roof. After it is constructed, the frame tent is typically staked to the ground.

Frame tents typically are not anchored to the ground during construction thereof. As a result, even moderate winds can make construction of the tent more difficult. There is a considerable risk of damage to the tent during construction, and even injury to persons nearby, especially during installation of the legs.

In addition, the fabric of frame tents is typically only loosely secured to the frame of the tent. The loosely secured fabric can flap in the wind, thereby stressing the frame of the tent. The flapping of the fabric also generates unwanted noise.

The preferred method in accordance with the present invention overcomes the problems of the prior art by providing a method of erecting an enclosure. Preferably, the enclosure is a tent. The frame of the tent is anchored to the ground during construction thereof. The tent preferably has fabric panels that extend between frame members of the tent. The fabric panels are tensioned between the frame members to improve the appearance of the tent and to reduce noise and frame stresses caused by flapping of the panels in the wind.

The tent is easily erected by unskilled workers with minimal specialized equipment. The tent comprises a number of relatively small frame components that can easily be transported from site to site. The tent is thus well-suited for short-term rental for parties and other gatherings.

In accordance with one aspect of a preferred method of the present invention, a method of erecting a tent comprising two or more beam assemblies is provided. Each of the beam assemblies comprises a roof portion and a pair of legs for supporting the roof portion. A number of base members are secured to the ground at predetermined locations. The roof portions are pivotally connected to the base members and rotated upwardly from the ground while maintaining the connection to the base members. A first side of each of the roof portions is disconnected from an associated one of the base members and raised above the base member. A first leg is connected to the first side. The first leg is then connected to the base member. A second side of each of the roof portions is disconnected from an associated one of the base members and raised above the base member. The second leg is connected to the second side. The second leg is then connected to the base member.

In accordance with another aspect of the present invention, a method of installing a panel of web material between two beam assemblies of a tent is provided. An adjustable-length purlin is attached between the beam assemblies. A keder of the panel is fed through a keder track formed in each of the beam assemblies. A length of the purlin is then increased to increase a distance between the beam assemblies and thereby tension the panel.

In accordance with yet another aspect of the present invention, a method of installing panels of web material between beam assemblies of a tent is provided. The beam assemblies are anchored to the ground at a number of base members. A first panel is installed between a first beam assembly and a second beam assembly by feeding a keder portion of the first panel into a keder track formed along each of the first and second beam assemblies. A second panel is installed between the second beam assembly and a third beam assembly by feeding a keder portion of the second panel into a keder track formed along each of the second and third beam assemblies. A tensioner is attached to the first and second panels. The first and second panels are pulled inwardly towards the second beam assembly and downwardly towards an associated one of the base members by the tensioner.

These and other aspects of the present invention will become readily apparent to those skilled in the art from the following detailed description of the preferred embodiments and the attached figures, the invention not being limited to any particular embodiment disclosed herein.

RELATED APPLICATION

The present application claims priority and benefit under 35 U.S.C. §119(e) of U.S. Provisional Patent Application Ser. No. 60/181,742, entitled "ENGINEERED FRAME TENT," filed Feb. 11, 2000 and hereby incorporated by reference herein.

DETAILED DESCRIPTION OF THE PREFERRED EMBODIMENT

Figure 1:
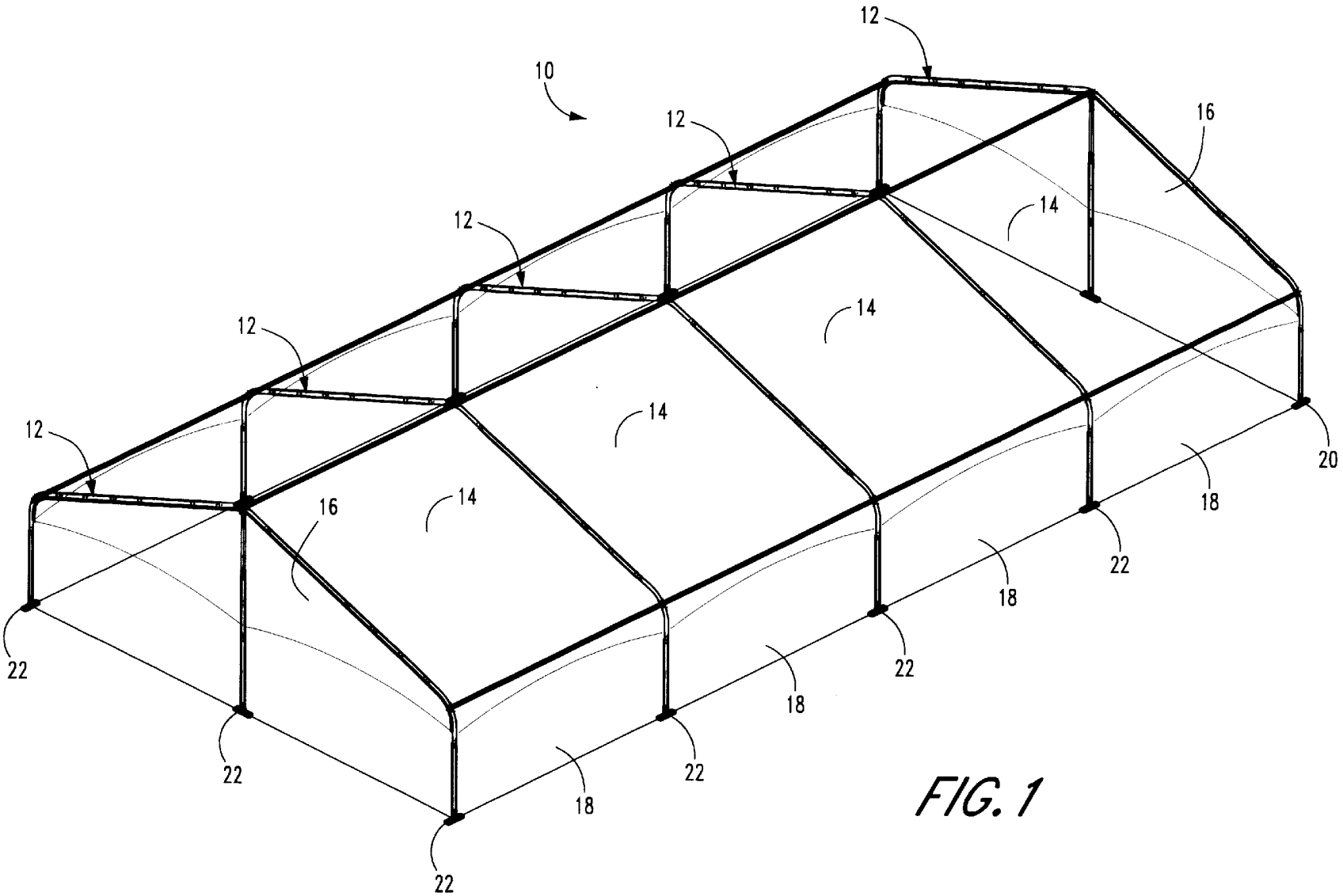
FIG. 1 is a perspective view of one embodiment of a tent having certain features and advantages in accordance with the present invention.

With reference to FIG. 1, a portable tent is illustrated and designated generally by the reference numeral 10. In the illustrated embodiment, the tent 10 comprises a number of tubular beam assemblies 12. The beam assemblies 12 support panels of a web material that extend between the beam assemblies 12, including top panels 14, end panels 16, and wall panels 18.

Figure 2:
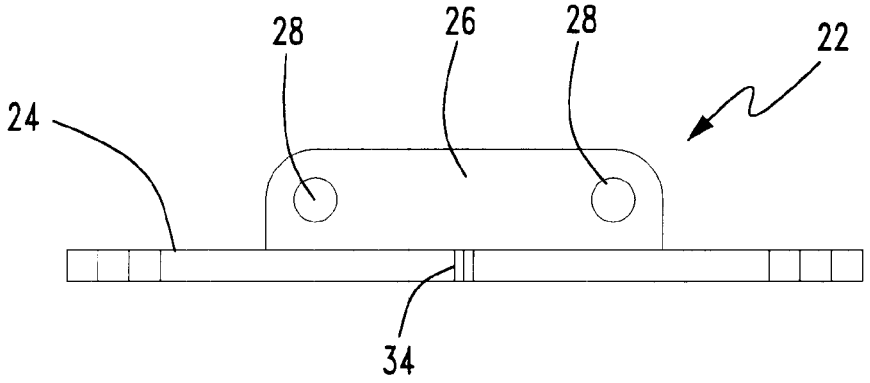
FIG. 2 is a front elevational view a base member of the tent of FIG. 1.
Figure 3:
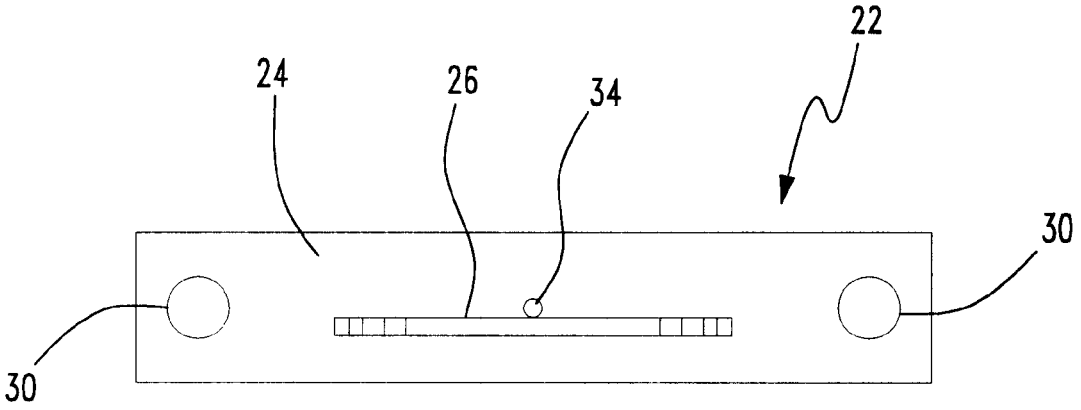
FIG. 3 is a top plan view of the base member.

The tent 10 is anchored to the ground at a number of base members 22. With reference to FIGS. 2 and 3, in the illustrated embodiment, each base member 22 comprises a base plate 24 and a pivot plate 26 that extends perpendicularly upwardly from a top surface of the base plate 24. An opening 28 is provided through each side of the pivot plate 26. An opening 30 similarly is provided through each side of the base plate 24. A smaller registration hole 34 is provided roughly through center of the base plate 24 at a side of the pivot plate 26.

Figure 4:
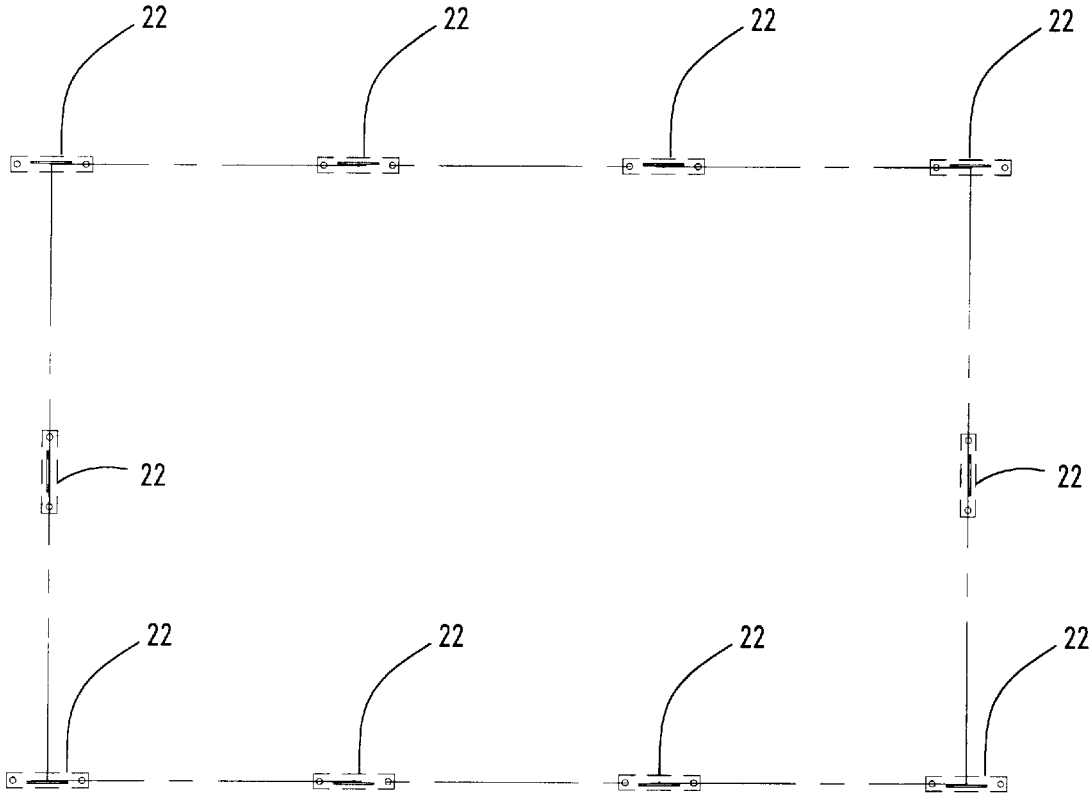
FIG. 4 is a top plan view of a layout of the base members.

With reference now to FIG. 4, the layout of the base members 22 is determined prior to assembling the tent 10 based upon the number and configuration of the beam assemblies 12. One base member 22 is provided for each side of each beam assembly 12. For tents that exceed 20 feet in width, a base member 22 preferably is also provided at each end of the tent 10, halfway between the base members 22 of the end beam assemblies 12.

The location of one of the corner base members 22 preferably is determined first. A registration pin 40 (see FIG. 5) is inserted into the ground to mark the desired location of the first comer base member 22. By measuring distances from the first registration pin 40, the locations of the base members 22 of a first side or first end of the tent 10 are established and also marked with registration pins 40. The locations of the remaining base members 22 are determined and marked with registration pins 40 by measuring from the registration pins 40 of the first side or end.

Figure 5:
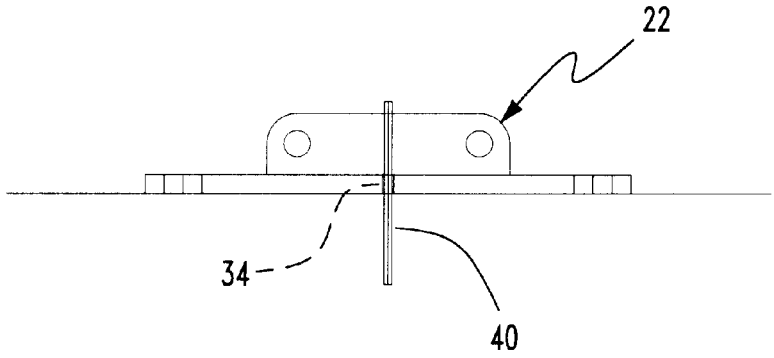
FIG. 5 is a front elevational view of the base member with a registration pin extending through an opening in a base plate thereof.
Figure 6:
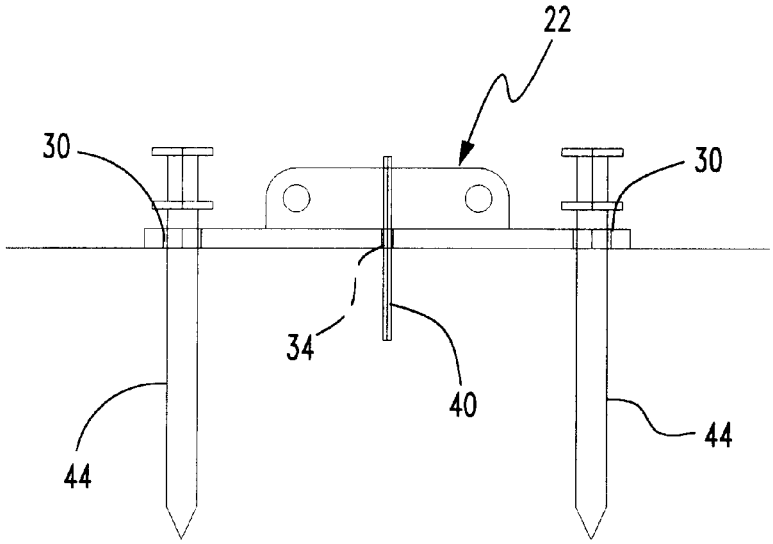
FIG. 6 is a front elevational view of the base member and registration pin with a stake extending t ugh an opening in each side of the base plate.

After the locations of the base members 22 have been properly marked, the base members 22 are placed over the registration pins 40 so that the registration pins 40 extend through the registration holes 34 in the base plates 24, as illustrated in FIG. 5. The base members 22 are then secured to the ground with stakes 44 that extend into the ground through the openings 30 in the base plates 24, as illustrated in FIG. 6. The registration pins 40 can then be removed.

Figure 7:
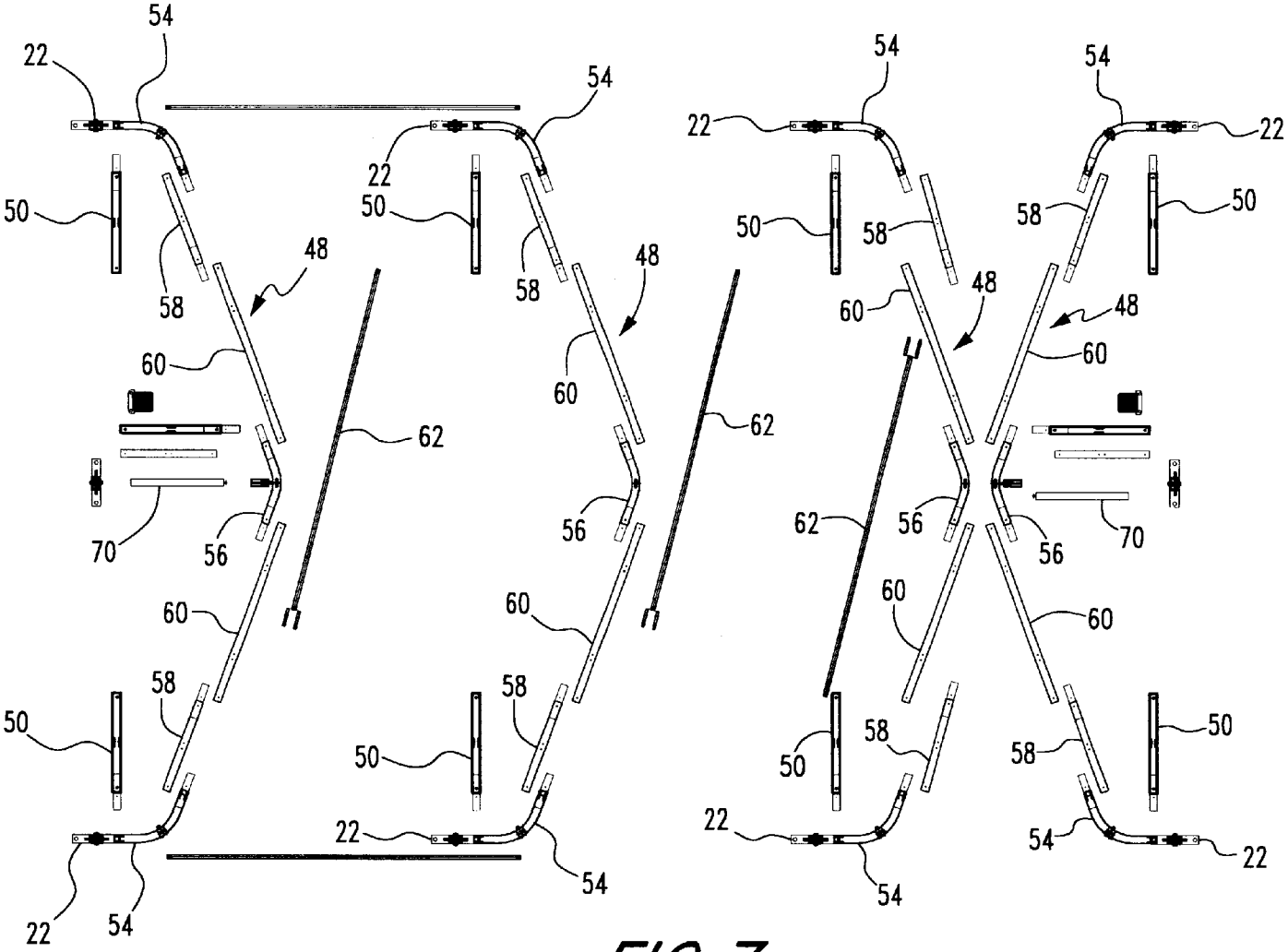
FIG. 7 is a top plan view of a layout of various components of the tent.

With reference now to FIG. 7, the various components of the beam assemblies 12 are laid out on the ground and arranged in relation to the base members 22 for assembly. The arrangement shown in FIG. 7 is preferred because it requires the least ground surface area.

As illustrated in FIG. 7, each beam assembly 12 comprises a roof portion 48 and a pair of legs 50 for supporting the roof portion 48. The roof portion 48 comprises a pair of curved eaves 54 and a curved apex 56. In the illustrated embodiment, a straight short beam 58 and a straight long beam 60 are provided for connection between each of the eaves 54 and the apex 56.

Figure 8:
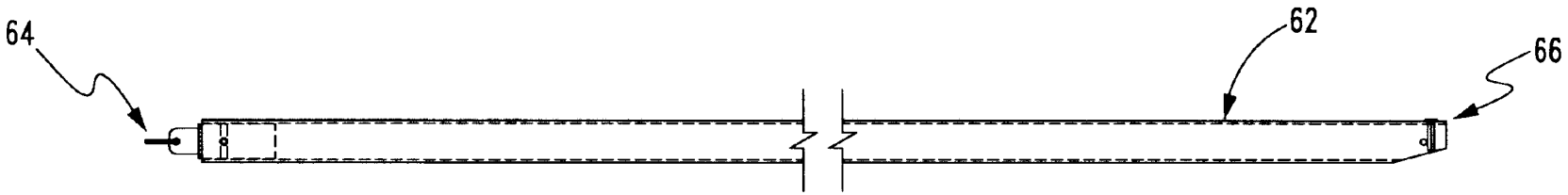
FIG. 8 is a front elevational view of a top purlin of the tent.
Figure 9:
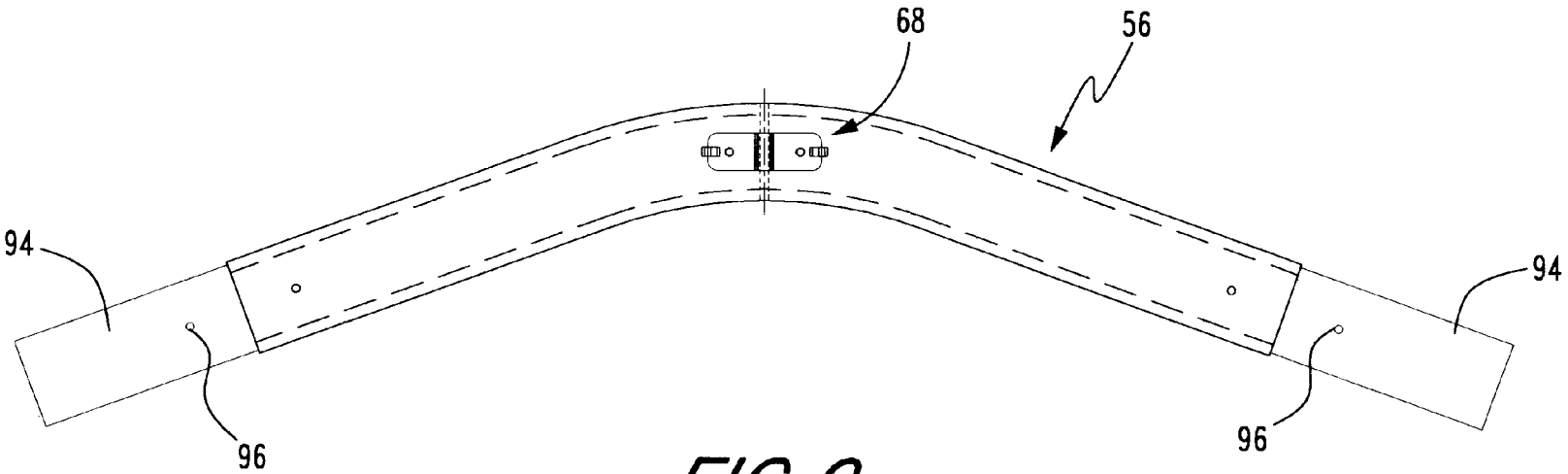
FIG. 9 is a front elevational view of an apex of the tent.

Prior to assembling the roof portion 48 at a first end of the tent 10, a top purlin 62 preferably is attached to the apex 56 thereof. As illustrated in FIG. 8, the top purlin 62 has a pivot end 64 and a drop-in end 66. The pivot end 64 of the top purlin 62 is pivotally attached to a bracket 68 (see FIG. 9) at an interior side of the apex 56. A top insert 70 (see FIG. 7) preferably is also attached to the apex 56 at the bracket 68.

Figure 10:
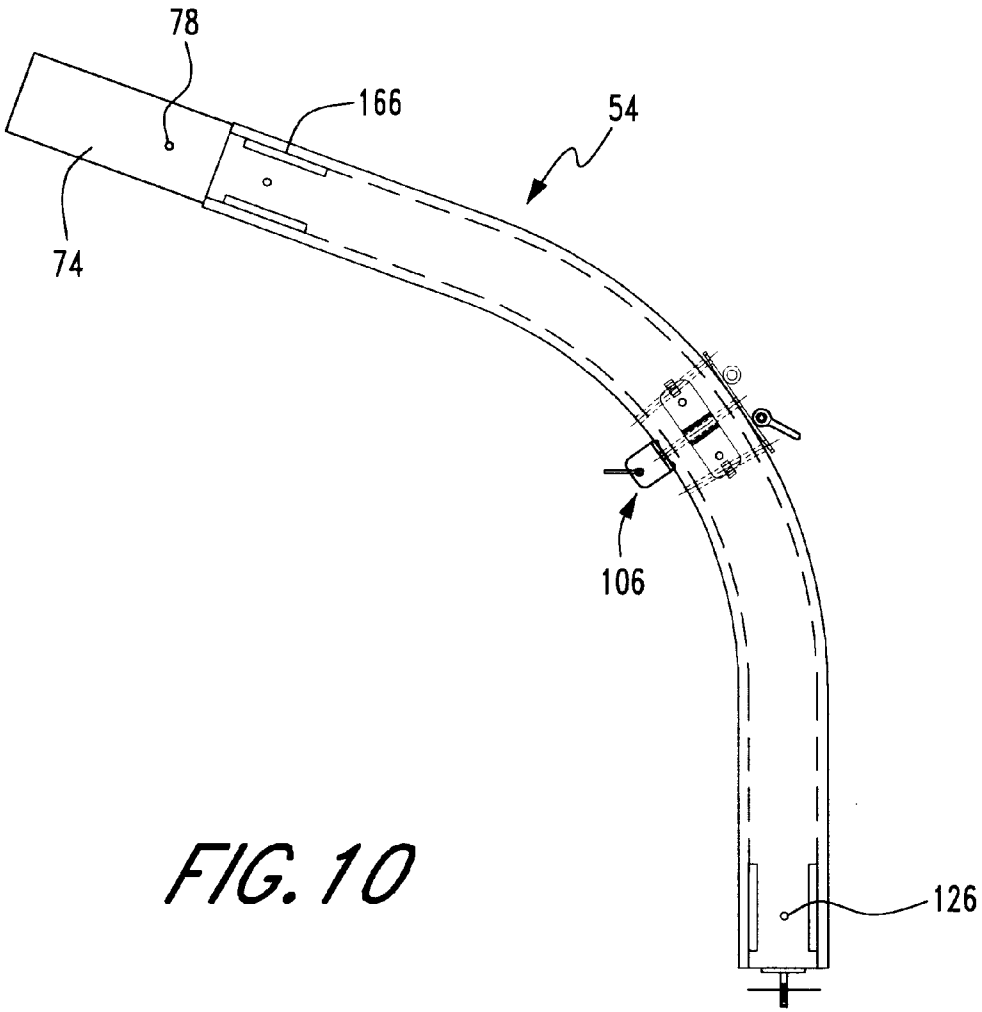
FIG. 10 is a front elevational view of an eave of the tent.

Each of the roof portions 48 is preferably assembled beginning at one of the eaves 54. With reference to FIG. 10, an insert 74 extends from an upper end of each eave 54. A pair of retractable buttons 78 extend from an outer surface of each insert 74.

Figure 11:
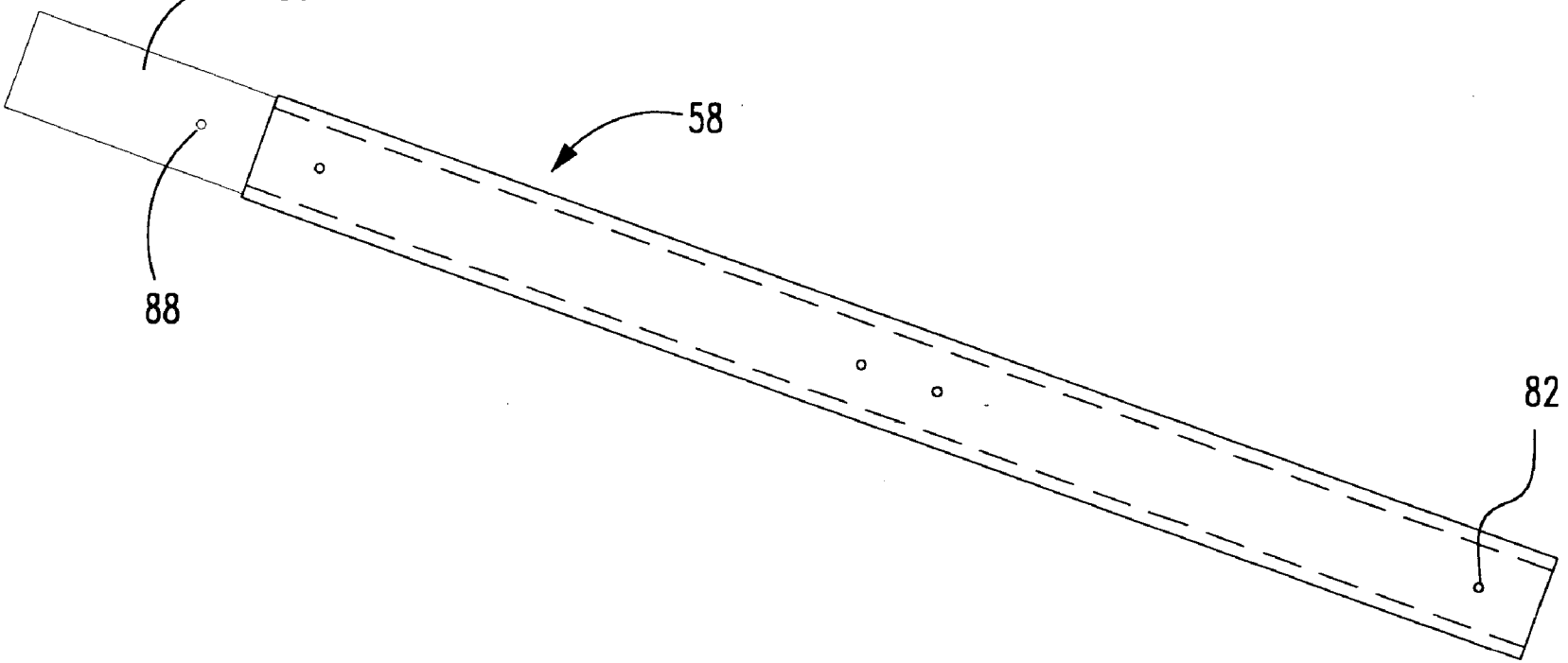
FIG. 11 is a front elevational view of a short beam of the tent.

The insert 74 of the eave 54 fits into a first end of the short beam 58. The assembly preferably is carried out by two persons. One person holds the eave 54 and retracts the buttons 78 extending from the insert 74 while the other person slides the first end of the short beam 58 over the insert 74. As illustrated in FIG. 11, a pair of openings 82 are provided near the first end of the short beam 58. When the insert 74 of the eave 54 is fully inserted in the short beam 58, the buttons 78 are aligned with the openings 82 and engage the openings 82 to lock the short beam 58 to the cave 54.

Figure 12:
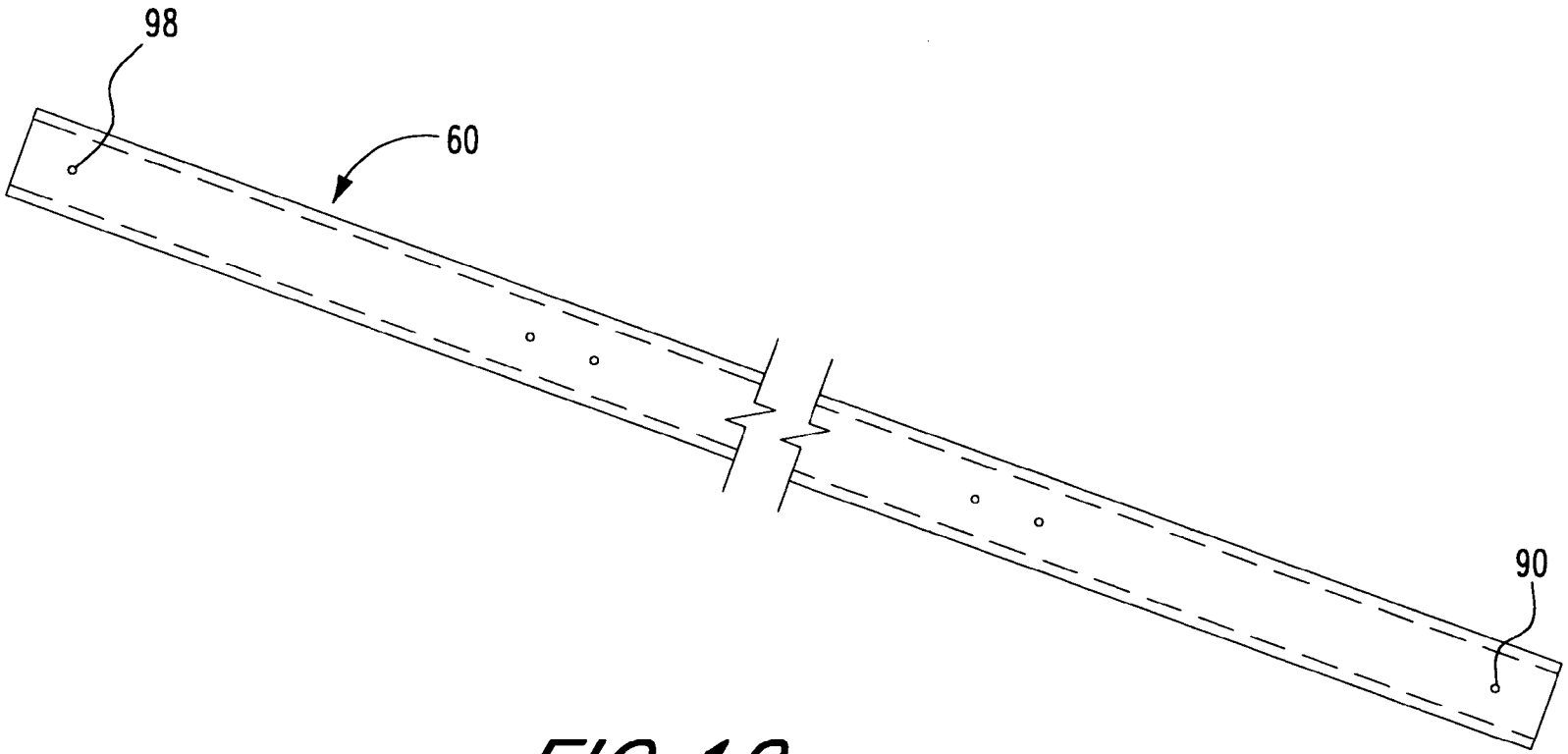
FIG. 12 is a front elevational view of a long beam of the tent.

The short beam 58 includes an insert 86 at a second end thereof. The insert 86 includes a pair of retractable buttons 88 that extend from an outer surface of the insert 86. The insert 86 of the short beam 58 fits into a first end of the long beam 60. A pair of openings 90 are provided in the first end of the long beam 60, as illustrated in FIG. 12. When the end of the long beam 60 is slid over the insert 86, the buttons 88 are aligned with the openings 90 and engage the openings 90 to lock the long beam 60 to the short beam 58.

Referring again to FIG. 9, an insert 94 is also provided at each end of the apex 56. Each insert 94 includes a pair of retractable buttons 96 that extend from an outer surface of the insert 94. The insert 94 fits into a second end of the long beam 60. A pair of openings 98 are provided in the second end of the long beam 60, as illustrated in FIG. 12. When the second end of the long beam 60 is slid over the insert 94, the buttons 96 are aligned with the openings 98 and engage the openings 98 to lock the long beam 60 to the apex 56.

Figure 13:
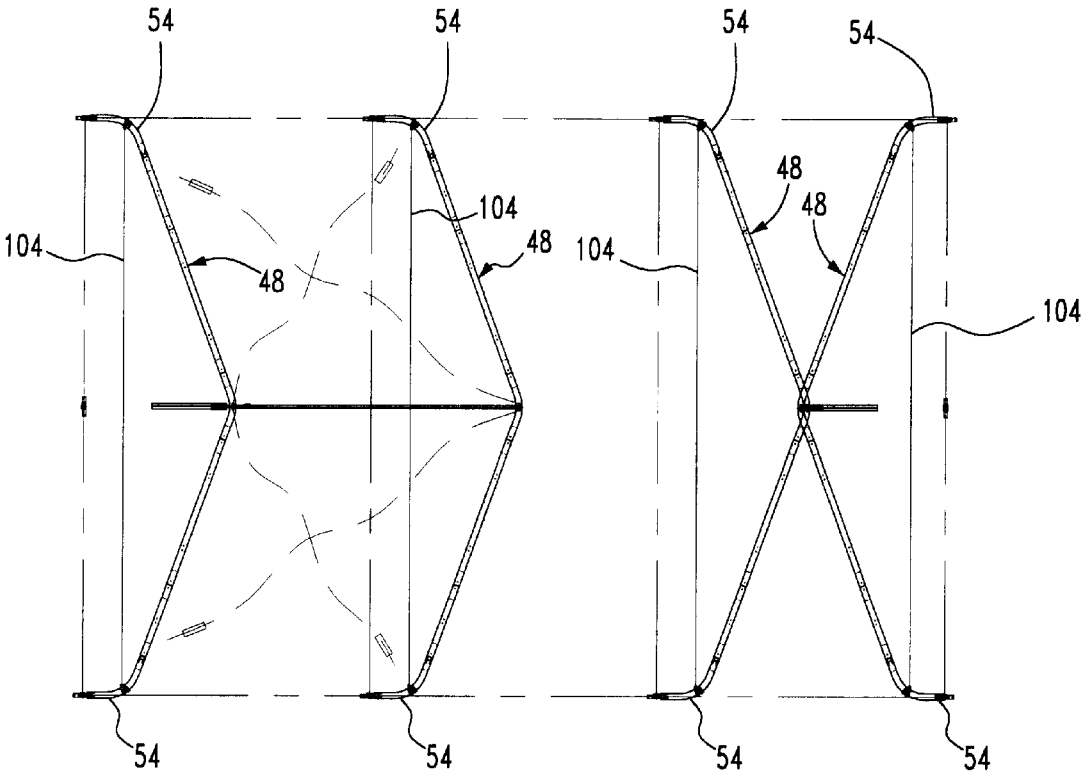
FIG. 13 is a top plan view of the roof portions of the tent.

The other side of the roof portion 48 is assembled in a similar fashion. After each of the roof portions 48 has been assembled, an assembly cable 104 desirably is attached between the eaves 54 of each roof portion 48, as illustrated in FIG. 13. The assembly cables 104 help to hold the beam assemblies 12 together during construction of the tent 10, and can later be removed if desired. Each of the eaves 54 includes a bracket 106 (see FIG. 10) for attachment of an end of one of the assembly cables 104.

Figure 14:
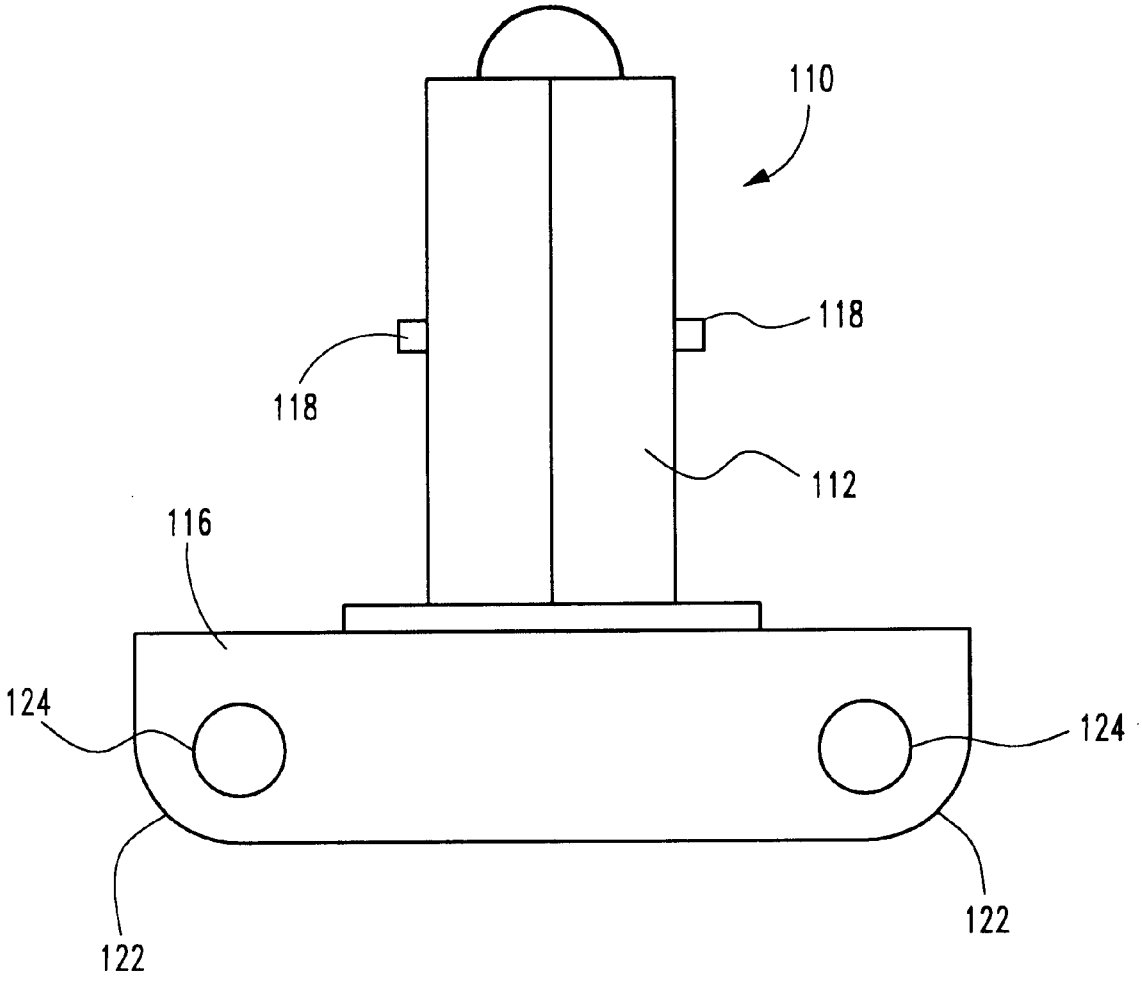
FIG. 14 is a front elevational view of a base insert of the tent.

With reference now to FIG. 14, a base insert 110 is illustrated comprising an insert portion 112 and a pivot plate 116 at an end of the insert portion 112. The insert portion 112 includes a pair of retractable buttons 118 that extend from an outer surface of the insert portion 112. The pivot plate 116 extends generally perpendicularly to the insert portion 112 and has rounded corners 122 at a lower end thereof. An opening 124 is provided through each side of the pivot plate 116.

One base insert 110 is desirably provided for each eave 54 of each roof portion 48. The insert portion 112 of the base insert 110 fits into a lower end of the eave 54. A pair of openings 126 are provided in the lower end of the eave 54, as illustrated in FIG. 10. When the insert portion 112 is slid into the lower end of the eave 54, the buttons 118 are aligned with the openings 124 and engage the openings 124 to lock the base insert 110 to the cave 54.

Figure 15:
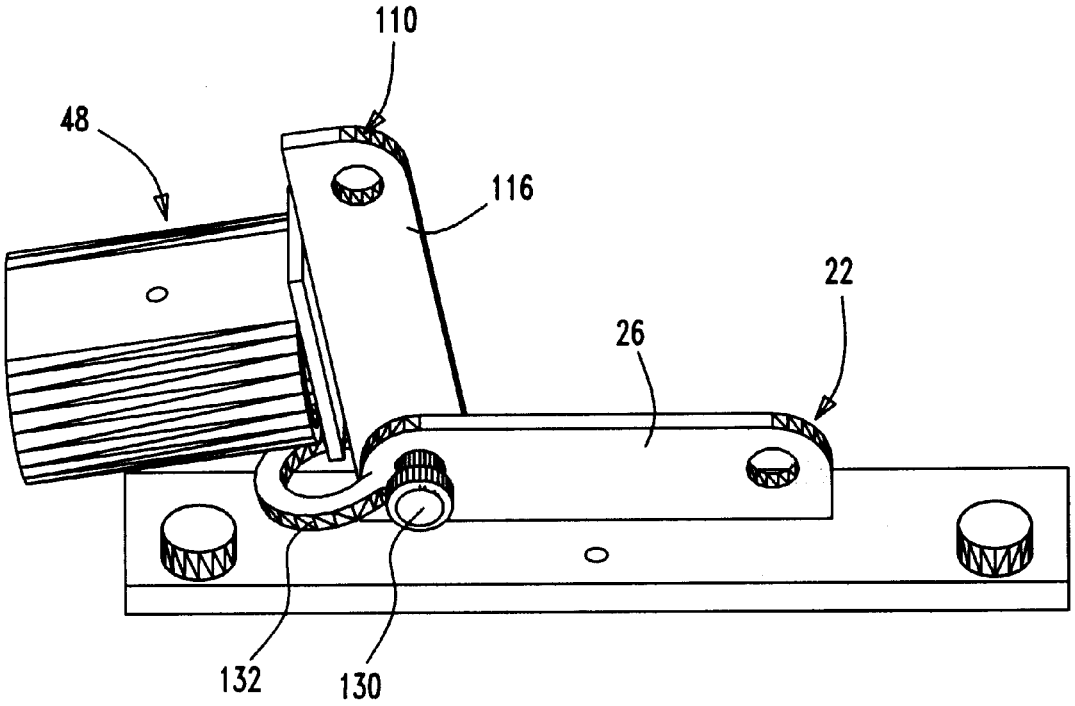
FIG. 15 is a perspective view of a roof portion pivotally connected to a base member.

With reference now to FIG. 15, the roof portions 48 desirably are positioned so that the pivot plates 116 of the base inserts 110 are located at the interior sides of the pivot plates 26 of the base members 22. The lower opening 124 in the pivot plate 116 of each base insert 110 is aligned with the opening 28 closest to the eave 54 in the pivot plate 26 of each base member 22. The roof portions 48 are then temporarily connected to the base members 22 by passing a bolt 130 of a shackle 132 through the aligned openings 28, 124. This allows the roof portions 48 to rotate relative to the base members 22.

Figure 16:
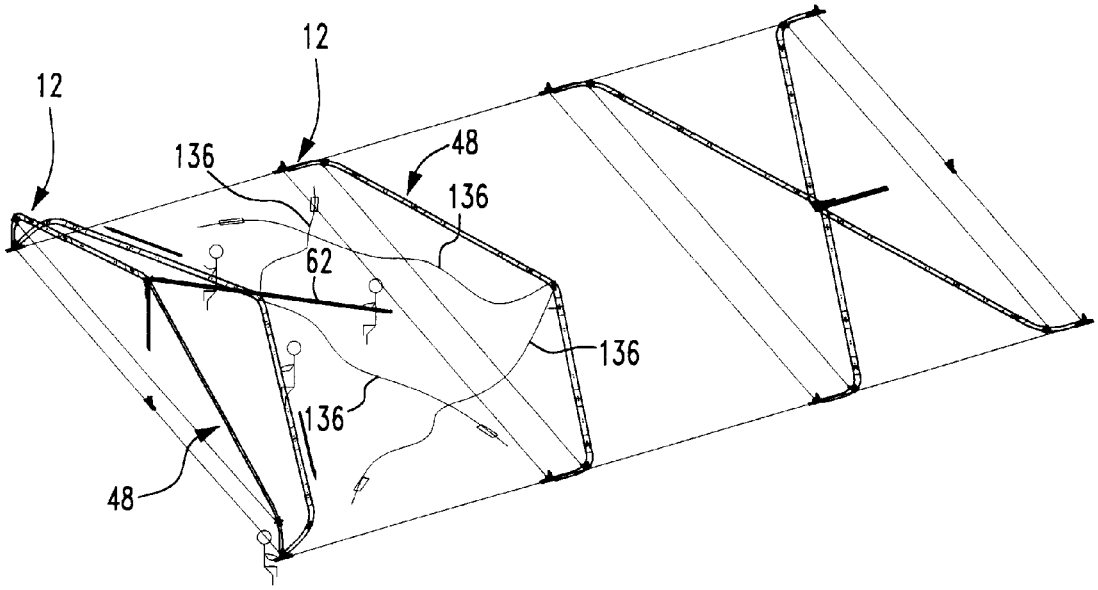
FIG. 16 is a perspective illustration of the lifting of a first roof portion of the tent.

A pair of bracing cables 136 preferably is next attached to the bracket 68 at the apex 56 of the roof portions 48 of each of the first and second beam assemblies 12, as illustrated in FIG. 16. The first roof portion 48 is then rotated upwardly from the ground, preferably with one person lifting at each side of the apex 56 and one person pushing and controlling the roof portion 48 with the top purlin 62. As the roof portion 48 is rotated upwardly, the pivot plates 116 of the base inserts 110 rotate on the base plates 24 of the base members 22. The rounded comers 122 of the pivot plates 116 facilitate rotation of the base inserts 110 on the base plates 24.

Figure 17:
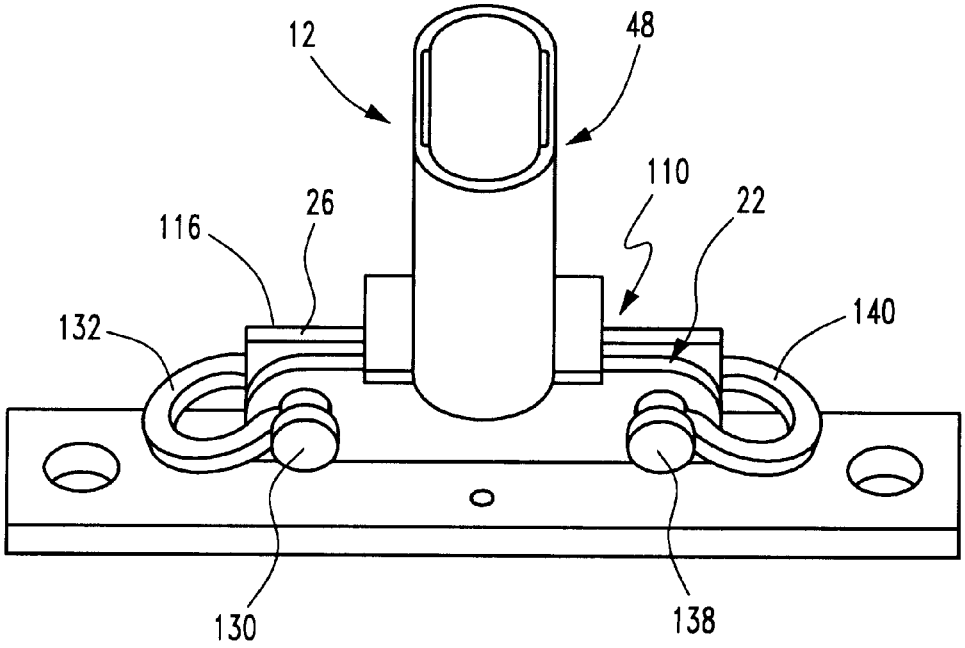
FIG. 17 is a perspective view of a roof portion fixedly connected to a base member.

When the roof portion 48 is vertical, the second openings 124 in the pivot plates 116 of the base inserts 110 are aligned with the second openings 28 in the pivot plates 26 of the base members 22. The roof portion 48 of the first beam assembly 12 is then temporarily secured to the base members 22 by passing a bolt 138 of a second shackle 140 through the aligned second openings 28, 124, as illustrated in FIG. 17. This prevents further rotation of the roof portion 48 with respect to the base members 22.

Figure 18:
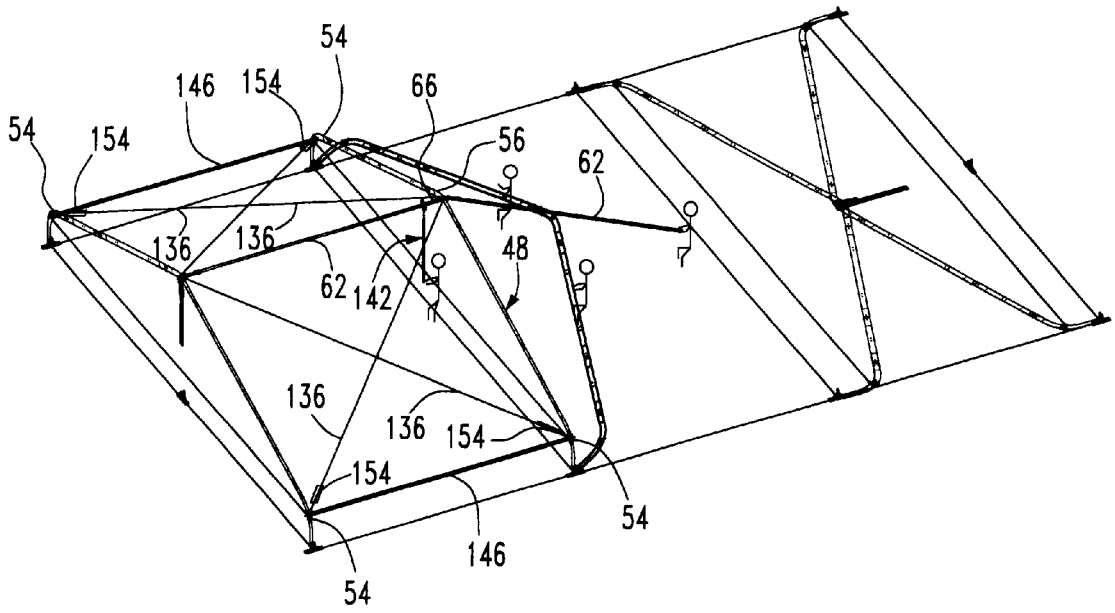
FIG. 18 is a perspective illustration of the lifting of a second roof portion of the tent.

The roof portion 48 of the second beam assembly 12 is raised in a similar fashion. A top purlin 62 is first attached to the bracket 68 of the apex 56 of the second roof portion 48 at a side of the apex 56 opposite the first roof portion 48. The second roof portion 48 is then rotated upwardly from the ground, as illustrated in FIG. 18, preferably with one person lifting at each side of the apex 56 and one person pushing and controlling the roof portion 48 with the top purlin 62. When the roof portion 48 is vertical, the second openings 124 in the pivot plates 116 of the base inserts 110 are aligned with the second openings 28 in the pivot plates 26 of the base members 22. The roof portion 48 is then temporarily secured to the base members 22 by passing a bolt 138 of a second shackle 140 through the aligned second openings 28, 124.

The drop-in end 66 of the top purlin 62 is attached to the roof portion 48 of the second beam assembly 12 by inserting the drop-in end 66 into the bracket 68 at the apex 56 of the second beam assembly 48. A purlin lift tool 142 can be used to lift the top purlin 62 into the bracket 68. A pair of lower purlins 146 is then connected between adjacent eaves 54 of the roof portions 48 of the first and second beam assemblies 12, as illustrated in FIG. 18. The lower purlins 146 are connected to brackets 148 located at the eaves 54 of the first and second beam assemblies 12, and are described in greater detail below.

The bracing cables 136 are next attached to the brackets 148 at the eaves 54 of the first and second roof portions 48.

The bracing cables 136 are lightly tensioned by adjusting a turnbuckle 154 at an end of each bracing cable 136. Any vertical misalignment of the roof portions 48 can be corrected by adjusting the turnbuckles 154.

Figure 19:
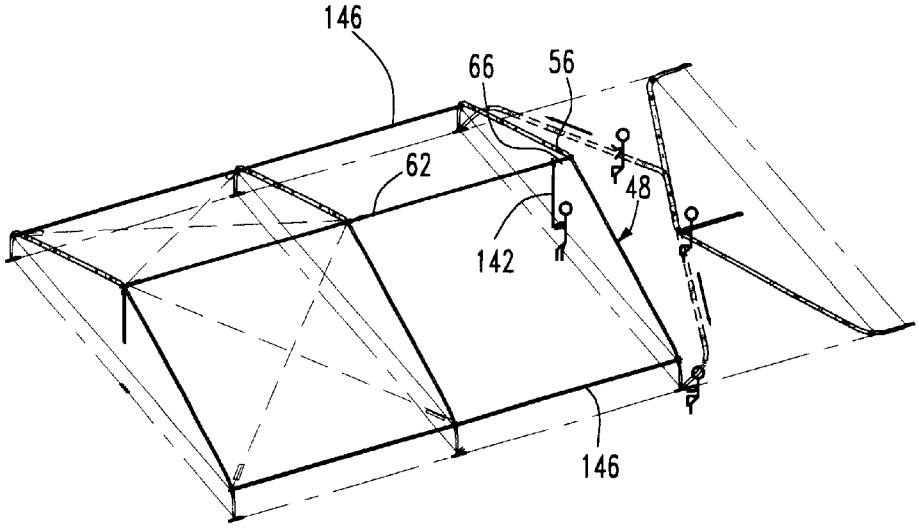
FIG. 19 is a perspective illustration of the lifting of a third roof portion of the tent.

The roof portion 48 of the third beam assembly 12 preferably is raised without first connecting a top purlin 62 to the apex 56 thereof. As illustrated in FIG. 19, the roof portion 48 is rotated upwardly from the ground, preferably with one person lifting at each side of the apex 56. When the roof portion 48 is vertical, the second openings 124 in the pivot plates 116 of the base inserts 110 are aligned with the second openings 28 in the pivot plates 26 of the base members 22. The roof portion 48 is then temporarily secured to the base members 22 by passing a bolt 138 of a second shackle 140 through the aligned second openings 28, 124. The drop-in end 66 of the top purlin 62 is then connected to the bracket 68 at the apex 56 of the third beam assembly 12 using the purlin lift tool 142. A second pair of lower purlins 146 is connected between adjacent eaves 54 of the roof portions 48 of the second and third beam assemblies 12.

Figure 20:
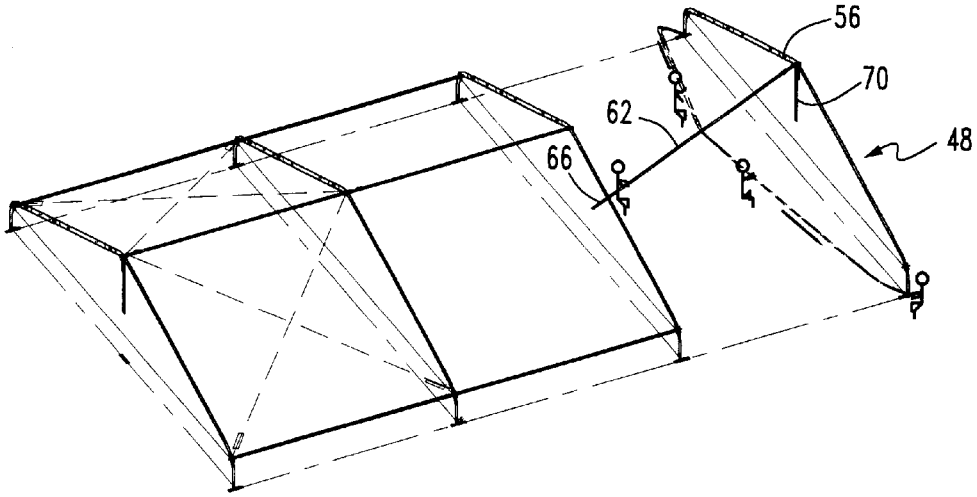
FIG. 20 is a perspective illustration of the lifting of a fourth roof portion of the tent.

The roof portion 48 of the fourth beam assembly 12 preferably is raised in the opposite direction. A top purlin 62 is first pivotally attached to the bracket 68 at the apex 56 of the fourth beam assembly 12. A top insert 70 also is preferably attached. The fourth roof portion 48 is then rotated upwardly from the ground, as illustrated in FIG. 20, preferably with one person lifting at each side of the apex 56 and one person pushing and controlling the roof portion 48 with the top purlin 62. When the roof portion 48 is vertical, the second openings 124 in the pivot plates 116 of the base inserts 110 are aligned with the second openings 28 in the pivot plates 26 of the base members 22. The roof portion 48 is then temporarily secured to the base members 22 by passing a bolt 138 of a second shackle 140 through the aligned second openings 28, 124. The drop-in end 66 of the top purlin 62 is then connected to the bracket 68 at the apex 56 of the third beam assembly 12 using the purlin lift tool 142. A third pair of lower purlins 146 is connected between adjacent eaves 54 of the roof portions 48 of the third and fourth beam assemblies 12.

Figure 21:
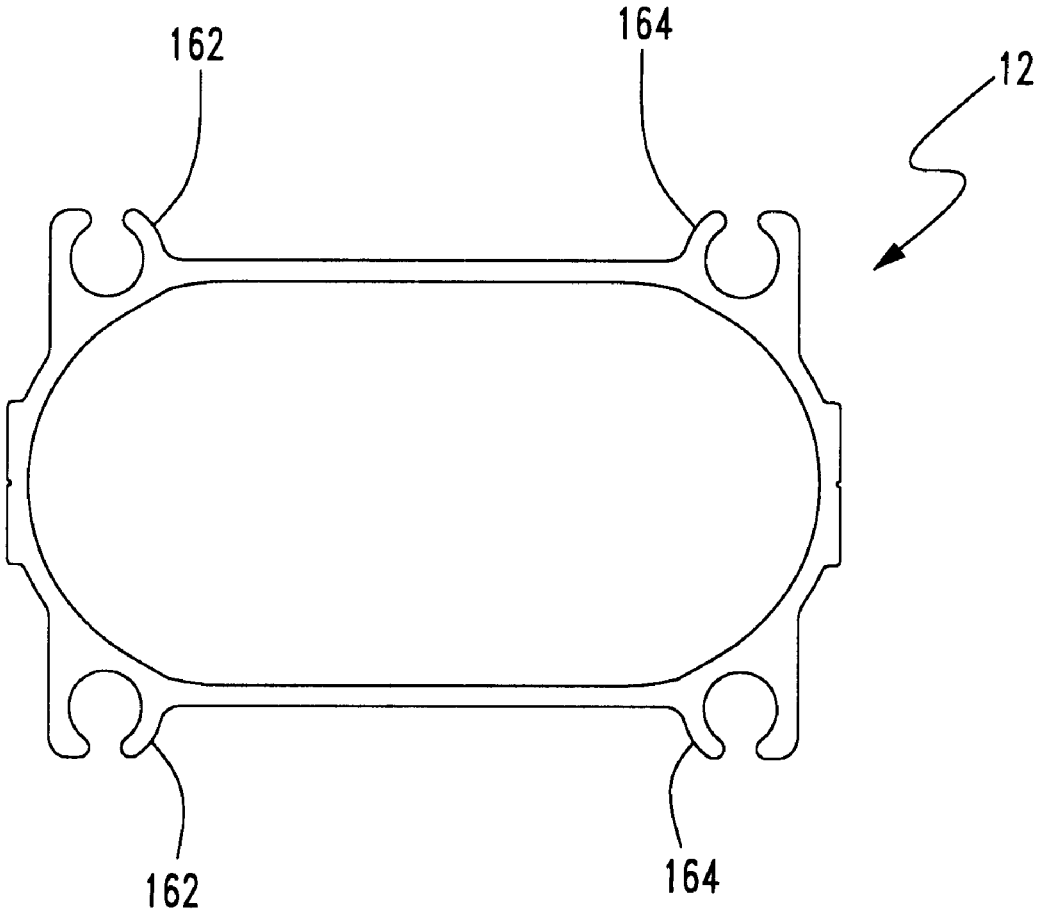
FIG. 21 is a cross-sectional view of a beam assembly of the tent.
Figure 22:
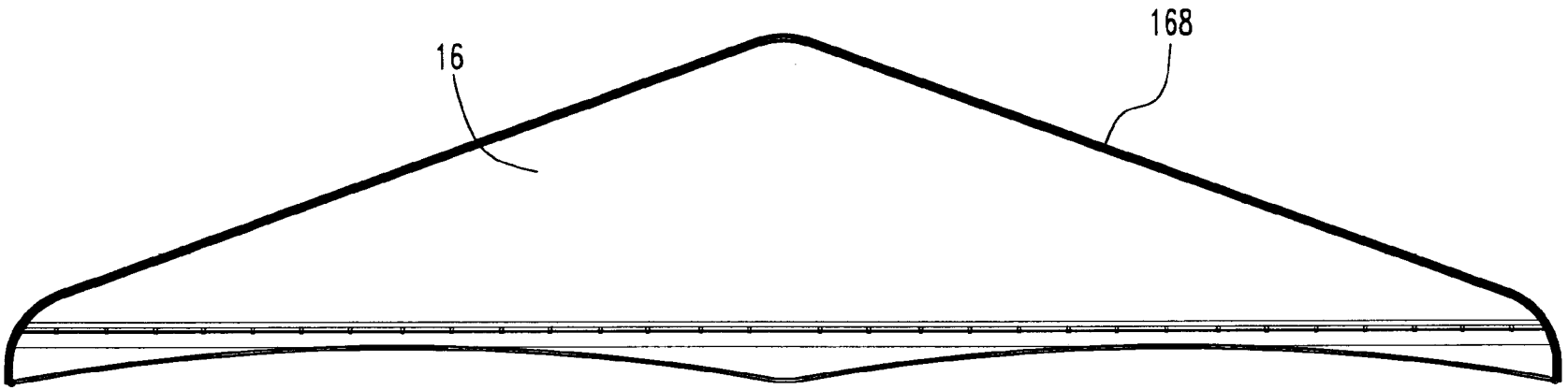
FIG. 22 is a front elevational view of an end panel of the tent.
Figure 23:
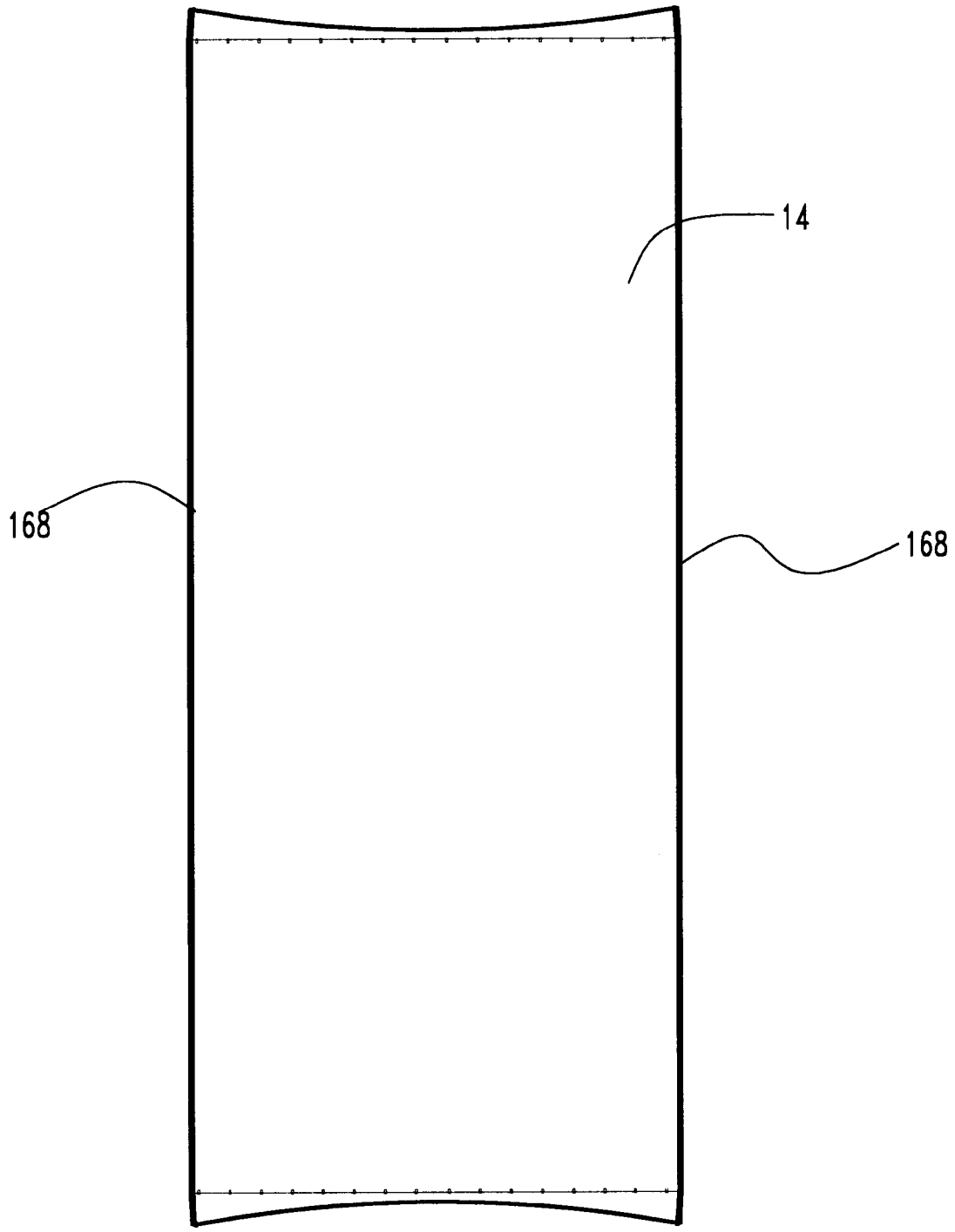
FIG. 23 is a front elevational view of a top panel of the tent.
Figure 24:
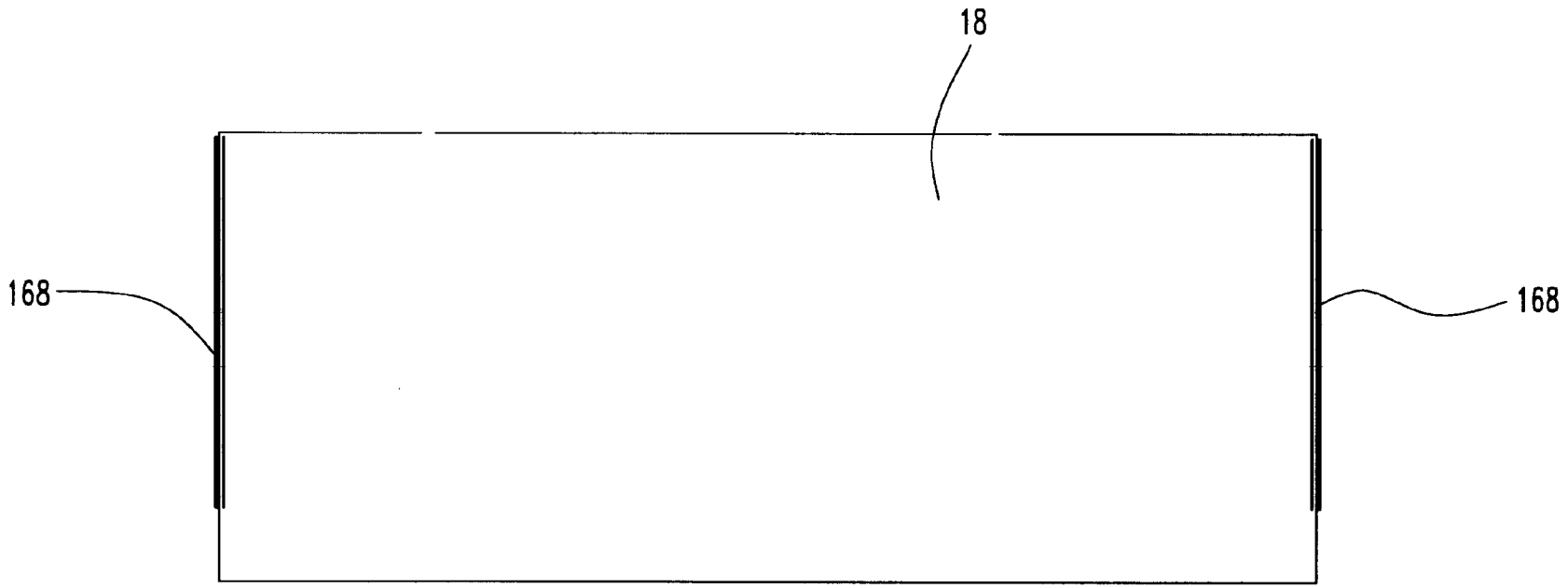
FIG. 24 is a front elevational view of a wall panel of the tent.

With the roof portions 48 of the beam assemblies 12 still secured to the base members 22, the end panels 16 and top panels 14 of the tent 10 are installed. With reference to FIG. 21, a cross section of one of the beam assemblies 12 is shown. As illustrated in FIG. 21, each component of the beam assemblies 12, including the eaves 54, short beams 58, long beams 60, apexes 56, and legs 50, defines a pair of outer or upper keder tracks 162 and a pair of inner or lower keder tracks 164. With reference to FIGS. 22, 23 and 24, each of the panels of the tent 10, including the top panels 14, end panels 16, and wall panels 18, includes a keder 168 that extends along a perimeter thereof. The keders 168 preferably comprise cords that are sewn to the panels 14, 16, 18 and fit into the keder tracks 162, 164 to secure the panels 14, 16, 18 to the beam assemblies 12.

Figure 25:
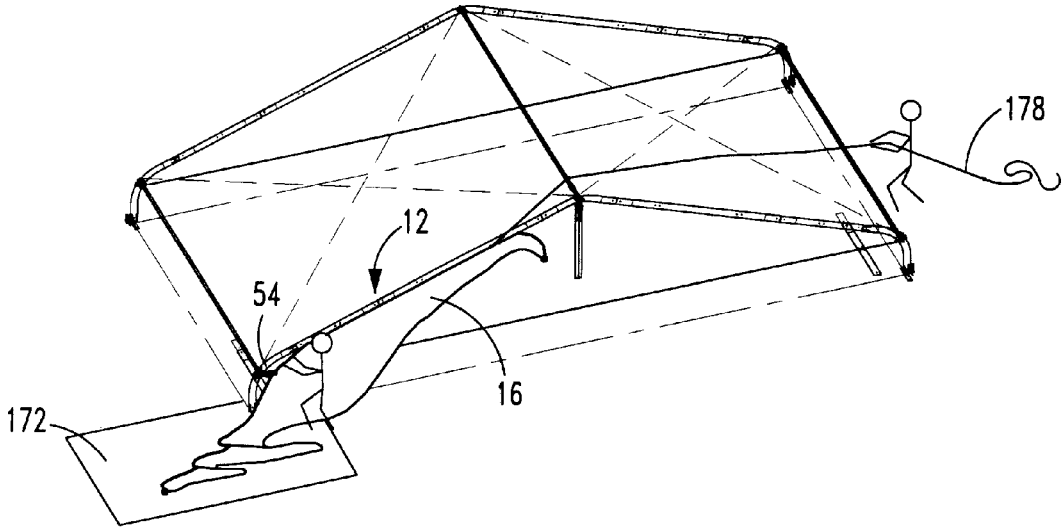
FIG. 25 is a perspective illustration of the installation of an end panel.

The end panels 16 preferably are installed first in the end beam assemblies 12. Each end panel 16 preferably is laid out onto a drop cloth 172 to prevent soiling of the panel 16, and arranged for installation in an end one of beam assemblies 12. With reference to FIG. 25, the keder 168 of the end panel 16 is fed into one of the lower keder tracks 164 of the beam assembly 12 starting at one of the eaves 54. A wider flared portion of the keder track 164 is provided at an upper portion of the eave 54 for insertion of the keder 168. An attachment ring (not shown) desirably is provided at a curved cave portion of the end panel 16 for attachment of a rope 178. While a first person. feeds the keder 168 into the keder track 164 at one side of the beam assembly 12, a second person pulls the keder 168 through the keder track 164 from the other side of the beam assembly 12 using the rope 178, as illustrated in FIG. 25. The end panel 16 is then centered and the ends of the panel 16 are fed through the keder tracks 164 at the lower portions of the eaves 54.

Figure 26:
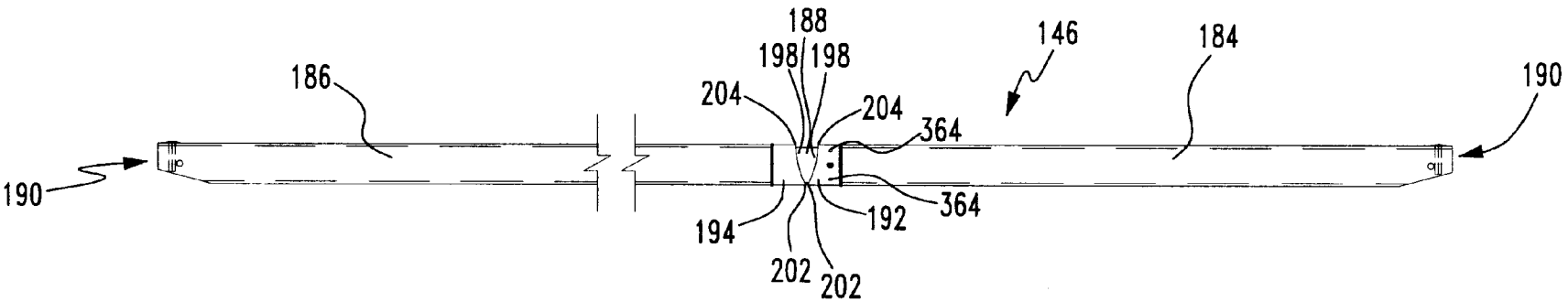
FIG. 26 is a front elevational view of a lower purlin of the tent.

The top panels 14 preferably are installed next. To facilitate installation of the top panels 14, the lower purlins 146 desirably are adjustable in length. With reference to FIG. 26, a preferred embodiment of one of the adjustable length purlins 146 is. shown. As illustrated in FIG. 26, the lower purlin 146 comprises a first tubular segment 184, a second tubular segment 186, and a third tubular segment 188. The third segment 188 desirably has an outer diameter that is slightly less than an inner diameter of the first and second segments 186, 188. The third segment 188 extends axially at least part way through each of the first and second segments 184, 186.

Each of the first and second segments 184, 186 includes a drop-in end 190 similar to the drop-in end 66 of the top purlins 62. A first cam 192 is provided at an end of the first segment 184 opposite the drop-in end 190 of the first segment 184. The first cam 160 desirably is rotatable with respect to the first segment 184. A second cam 194 is provided at an end of the second segment 186 opposite the drop-in end 190 of the second segment 186. The second cam 194 desirably is fixed with respect to the second segment 186.

Each of the first and second cams 192, 194 defines a cam surface 198. Each cam surface 198 generally defines a peak 202 and a valley 204. When the first cam 192 is rotated with respect to the second cam 194 so that the peak 202 of the first 192 cam resides in the valley 204 of the second cam 194, the overall length of the purlin 146 is minimized. Conversely, when first cam 192 is rotated so that the peak 202 of the first cam 192 resides against the peak. 202 of the second cam 194, the overall length of the purlin 146 is maximized. During installation of the top panels 14, it is desirable that the length of the lower purlins 146 be reduced in order to decrease the distance between adjacent roof portions 48 of the beam assemblies 12. An amount of slack is thereby created in the top panels 14. This serves to facilitate installation of the top panels 14 between the roof portions 48 of the beam assemblies 12.

Figure 27:
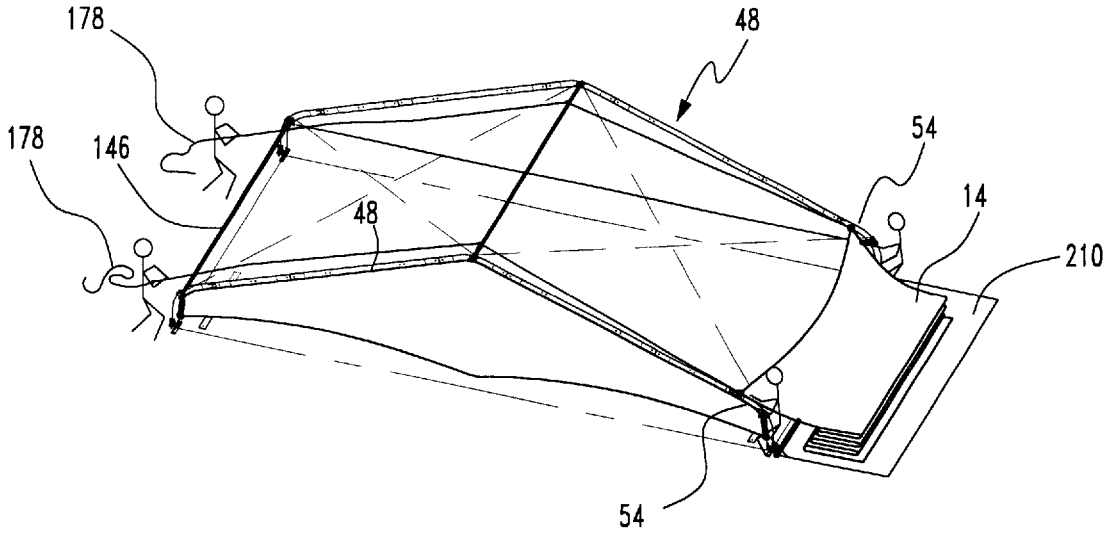
FIG. 27 is a perspective illustration of the installation of a top panel.

With the length of the lower purlins 146 reduced, each of the top panels 14 preferably is laid out onto a drop cloth 210 and arranged for installation between adjacent roof portions 48 of the tent 10, as illustrated in FIG. 27. The keders 168 of the top panel 14 are fed into the upper keder tracks 164 of the beam assemblies 12 starting at the eaves 54. A wider flared portion 166 (see FIG. 10) of the keder track 164 is provided at an upper portion of each of the eaves 54 for insertion of the keders 168.

While two people feed the keders 168 into the keder tracks 164 at one side of the tent 10, two other people pull the keders 168 through the keder tracks 164 from the other side of the tent 10 using ropes 178 attached to the top panel 14, as illustrated in FIG. 27. The keders 168 of the top panel 14 preferably are pulled through the keder tracks 164 evenly with concerted 8 to 12 inch pulls on the ropes 178. When the panel 14 is centered, the ends of the panel 14 are then fed through the keder tracks 164 at the lower portions of the eaves 54 past the lower purlins 146.

Desirably, the radius of curvature of the eaves 54 and apexes 56 is great enough to allow the top panels 14 and end panels 16 to slide through the keder tracks 164 of the eaves 54 and apexes 56 with relative ease. Preferably, the radius of curvature of the eaves 54 and apexes 56 is at least approximately 2 feet.

Figure 28:
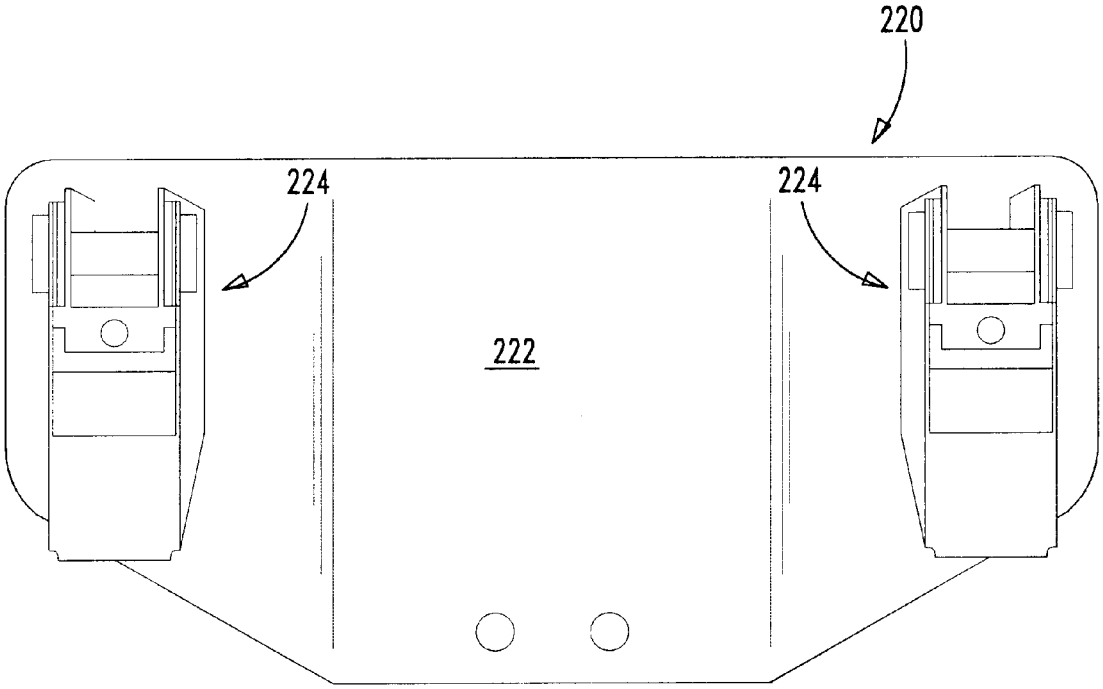
FIG. 28 is a front elevational view of a side tensioner of the tent.
Figure 29:
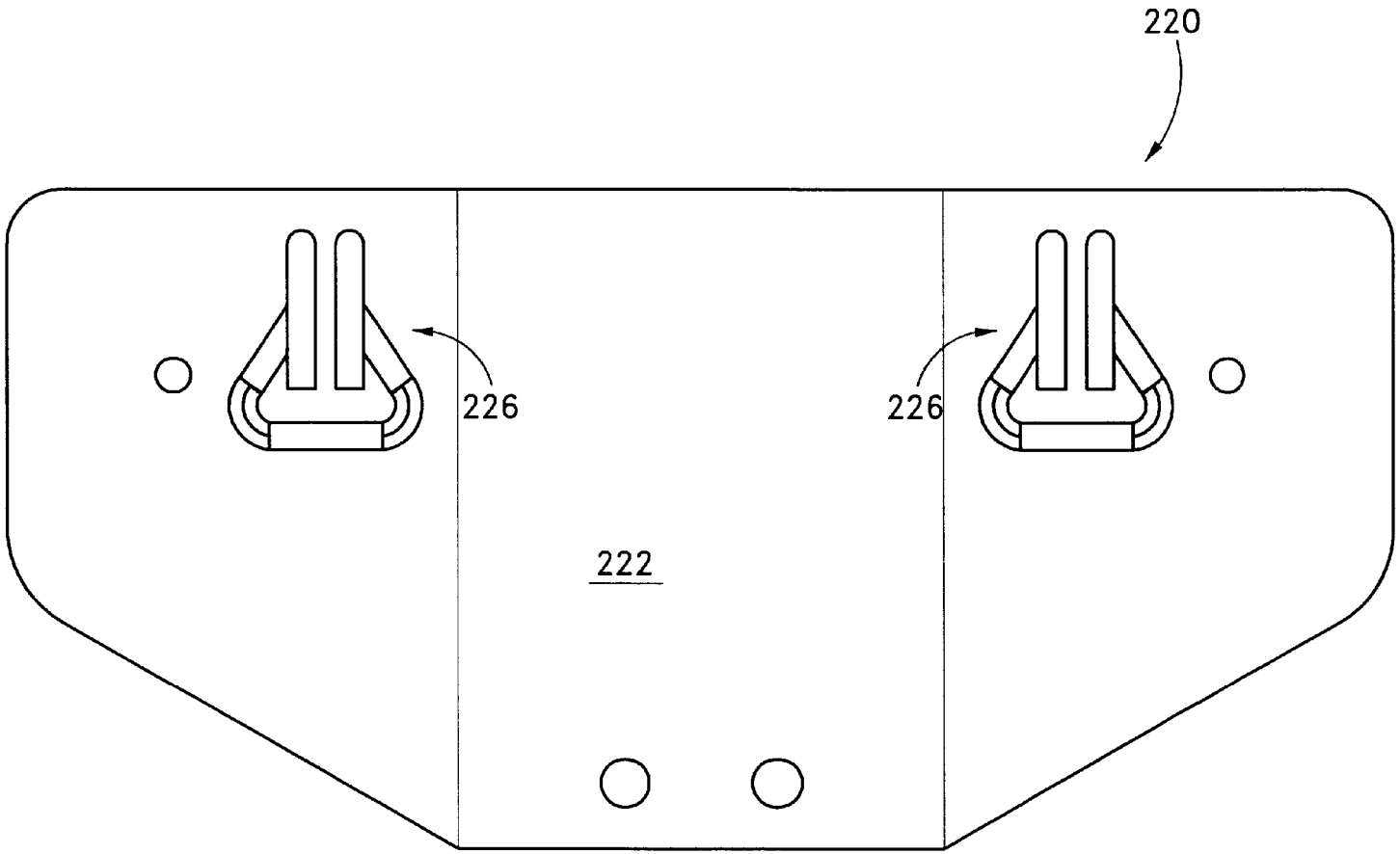
FIG. 29 is a rear elevational view of the side tensioner.

With reference now to FIGS. 28 and 29, a preferred embodiment of a side tensioner 220 for tensioning the top panels 14 is illustrated. The side tensioner 220 generally comprises a plate 222 that is contoured to fit against a side surface of the beam assemblies 12. A ratchet assembly 224 is attached to a front surface of the plate at each side thereof. A downwardly-projecting hook 226 extends from a rear surface of the plate 222 at each side thereof.

Figure 30:
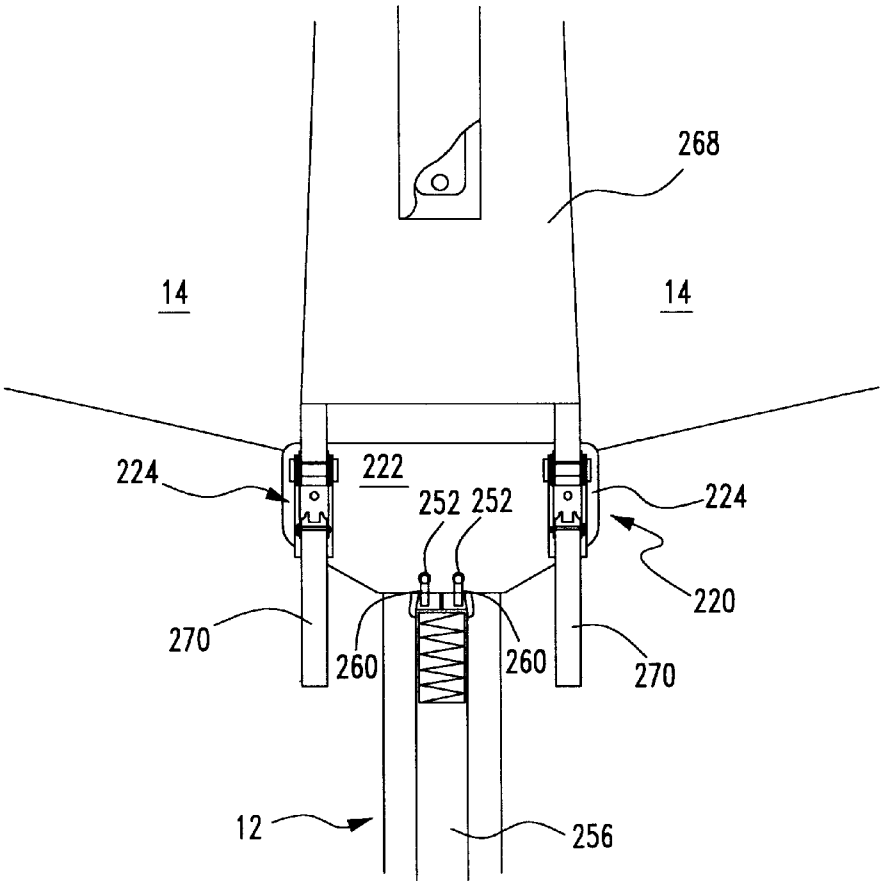
FIG. 30 is a front elevational view of the side tensioner installed at an interior beam assembly

Referring now to FIG. 30, the side tensioners 220 are positioned at the eaves 54 of the roof portions 48 of the interior beam assemblies 12. Each of the side tensioners 220 is attached to two of the top panels 14 by placing the hooks 226 at the rear of the tensioner 220 through a pair of rings 212 (see FIG. 44) located at the comers of the top panels 14. Thus, advantageously, each of the side tensioners 220 tensions two of the top panels 14 simultaneously.

Figure 31:
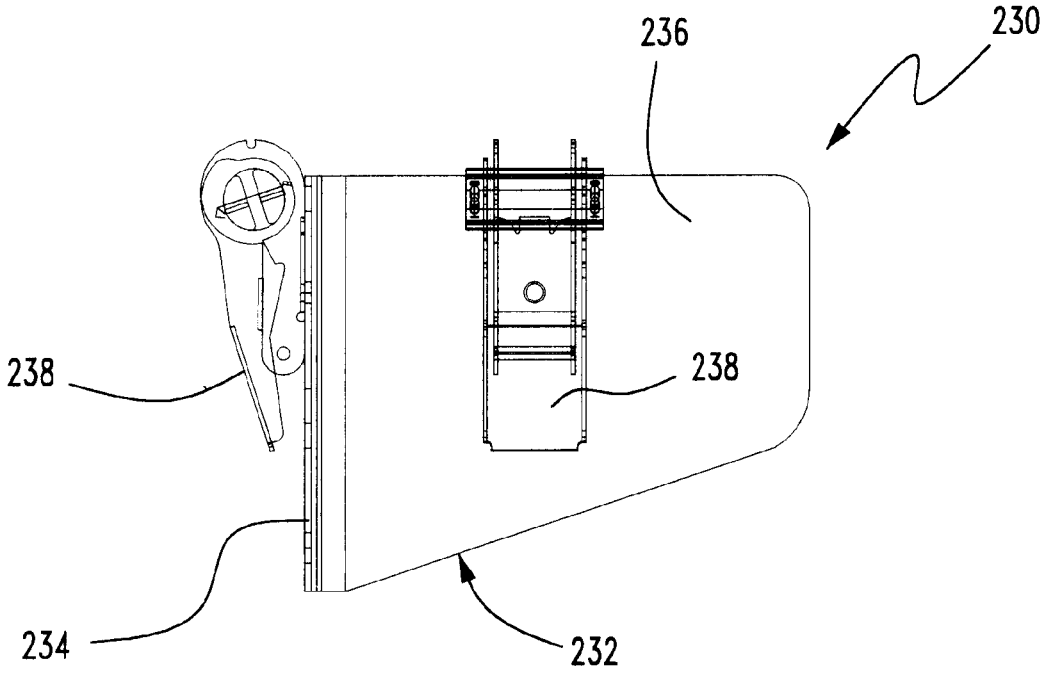
FIG. 31 is a front elevational view of a corner tensioner of the tent.

A corner tensioner 230 is provided for tensioning the end panels 16 and the top panels 14 at the corners of the tent 10. A preferred embodiment of the comer tensioner 230 is illustrated in FIG. 31. In the illustrated embodiment, the corner tensioner 230 comprises a plate 232 including a side portion 234 and an end portion 236 that extends generally perpendicularly to the side portion 234. A ratchet assembly 238 is attached to a front surface of each of the side and end portions 234, 236, and a downwardly-projecting hook (not shown) extends from a rear surface of each of the side and end portions 234, 236.

Figure 32:
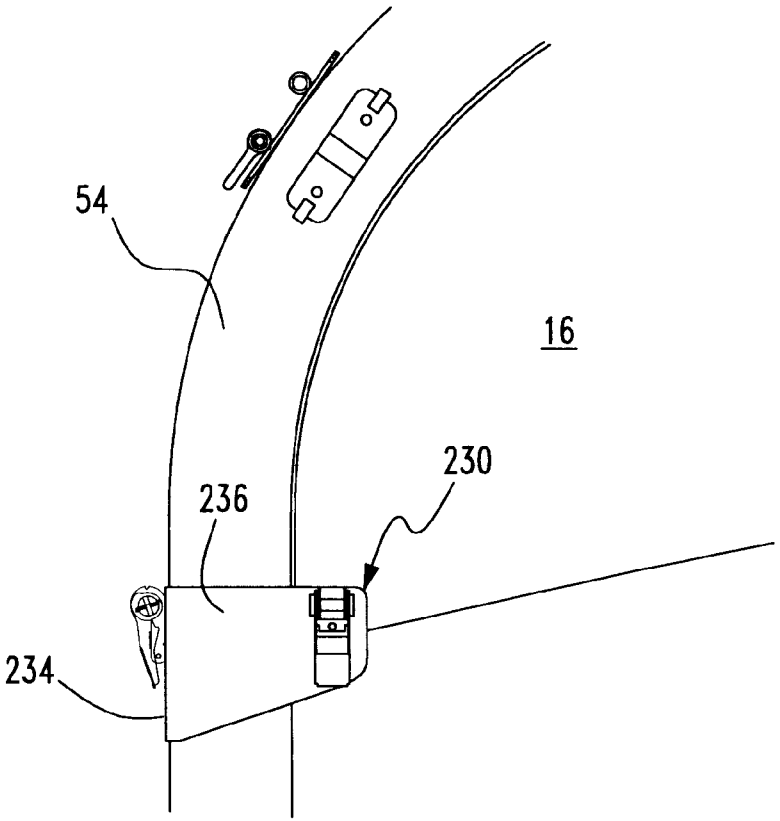
FIG. 32 is a front elevational view of the comer tensioner installed at an end beam assembly.

The corner tensioners 230 are positioned at the eaves 54 of the roof portions 48 of the end beam assemblies 12, as illustrated in FIG. 32. Each of the comer tensioners 230 is connected to one of the top panels 14 and one of the end panels 16. The hook at the rear of the side portion 234 is placed through the ring 212 at the comer of the top panel 14. The hook at the rear of the end portion 236 is placed through the ring 212 at the comer of the end panel 14. Thus, advantageously, each of the corner tensioners 230 tensions one of the top panels 14 and one of the end panels 16 simultaneously.

Referring again to FIG. 30, a pair of holes 252 are provided through the plate 222 of each of the side tensioners 220 for attachment of a tensioning strap 256. Each tensioning strap 256 desirably includes a pair of hooks 260 at a first end thereof, and a ratchet assembly 258 (see FIG. 43) at a second end thereof. The hooks 260 at the first ends of the tensioning straps 256 are placed through the holes 252 in the plates 222 of the side tensioners 220, preferably from the rear of the plates 222 so that the hooks 260 project away from the beam assemblies 12. Tensioning straps 256 are attached to the comer tensioners 230 in a similar manner.

A beam cover 268 desirably is next installed over each of the beam assemblies 12. The beam covers 268 serve to prevent water leakage between the top panels 14 and the roof portions 48 of the beam assemblies 12, and to hide the roof portions 48 to provide a more attractive appearance. While one person holds one end of the beam cover 268 centered over one of the eaves 54, another person pulls the beam cover 268 over the apex 256. It may be necessary to pull the beam cover 268 back and forth over the apex 56 in a sawing motion to center the beam cover 268 over the apex 256.

A pair of straps 270 extend from each end of each of the beam covers 268, as illustrated in FIG. 30. After the beam covers 268 are centered on the beam assemblies 12, the straps 270 are threaded through the ratchet assemblies 224 of the tensioners 220 to hold the beam covers 268 in place until final tensioning thereof.

Any lighting, decorations, or other fixtures that are to be hung from the roof portions 48 of the tent 10 can be installed next. The lighting and decorations preferably are attached to the brackets 68, 106 at the apexes 56 and the eaves 54 of the roof portions 48. Because the legs 50 of the tent 10 have not yet been installed, the brackets 68, 106 at the apexes 56 and the eaves 54 are near to the ground and within easy reach.

Figure 33:
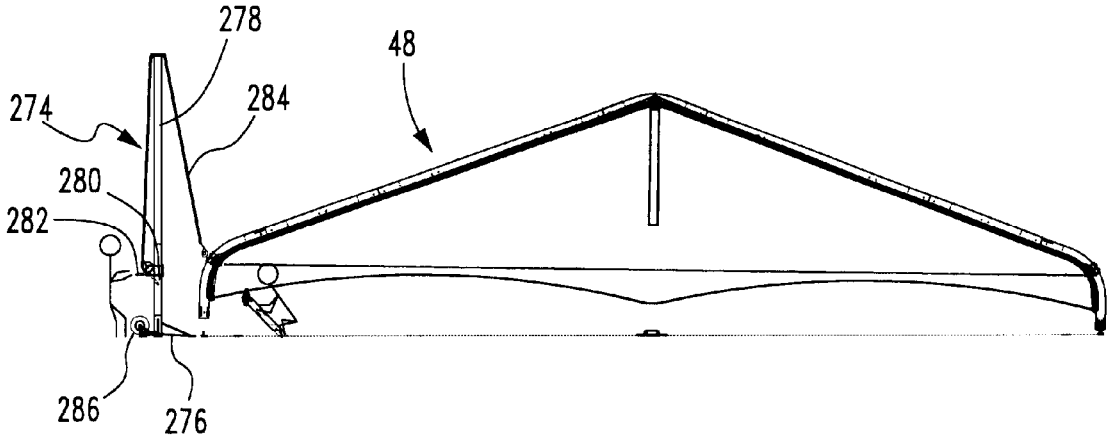
FIG. 33 is a front elevational illustration of the lifting of a first side of a roof portion of the tent.

With reference now to FIG. 33, the legs 50 of the tent 10 are installed by raising the roof portions 48 one side at a time. Because the assembled roof portions 48 are relatively heavy, a jack 274 preferably is provided at each of the roof portions 48 to lift the roof portions 48. In the illustrated embodiment, each of the jacks 274 comprises a base 276 and a post 278 that extends upwardly from the base 276. A winch assembly 280 is attached to the post 278 and includes crank arm 282. A strap 284 extends from the winch assembly 280 over a top end of the post 278. A pair of wheels 286 are rotatably connected to the base 276 to facilitate transporting of the jack 274.

Figure 34:
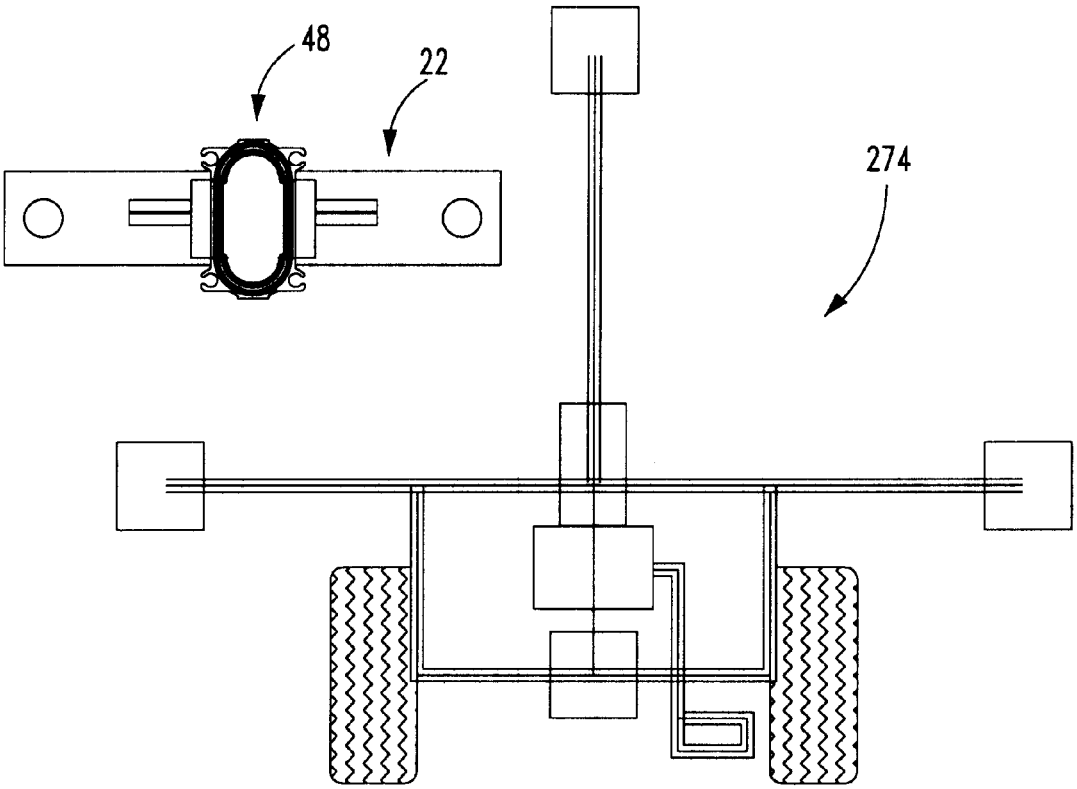
FIG. 34 is a top plan illustration of the placement of a jack relative to a roof portion of the tent.

One of the jacks 274 desirably is positioned at a first side of each of the roof portions 48, as illustrated in FIGS. 33 and 34. The straps 284 are connected to the brackets 106 at the eaves 54 of the roof portions 48. The first and second shackles 132, 140 are then removed to disconnect the first sides of the roof portions 48 from their associated base members 22.

The first sides of the roof portions 48 preferably are raised approximately 6 to 8 inches above the base members 22 by turning the crank arms 282 of the winch assemblies 280. All of the roof portions 48 preferably are raised substantially in unison to prevent damage to the roof portions 48. A second side of each of the roof portions 48 remains connected to one of the base members 22 as the first side is raised.

The base inserts 110 are removed from the eaves 54 at the first sides of the roof portions 48 by pressing the buttons 118 of the base inserts 110 to retract the buttons 118 into the openings 126 at the ends of the eaves 54. The base inserts 110 are then removed from the eaves 54 by sliding the insert portions 112 of the base inserts 110 out of the lower ends of the eaves 54.

Figure 35:
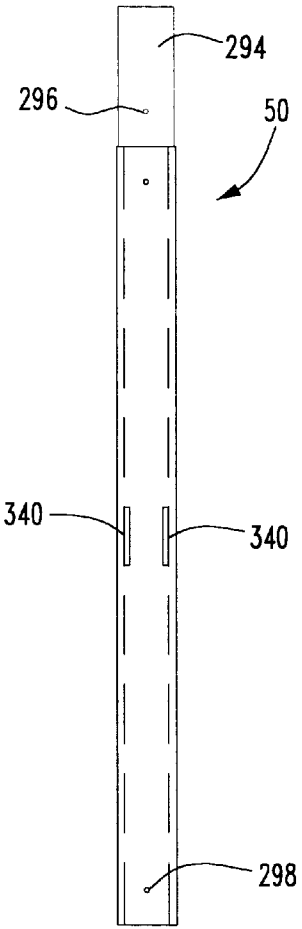
FIG. 35 is a front elevational view of a leg of the tent.

Once removed from the eaves 54, the base inserts 110 are connected to the legs 50. As illustrated in FIG. 35, each of the legs 50 includes an insert 294 at an upper end thereof. A pair of retractable buttons 296 extend from an outer surface of the insert 294. A pair of openings 298 are provided at a lower end of each of the legs 50. The insert portions 112 of the base inserts 110 are slid into the lower ends of the legs 50 so that the buttons 118 of the base inserts 110 are aligned with the openings 296 and engage the openings 296 to lock the base inserts 110 to the legs 50.

Figure 36:
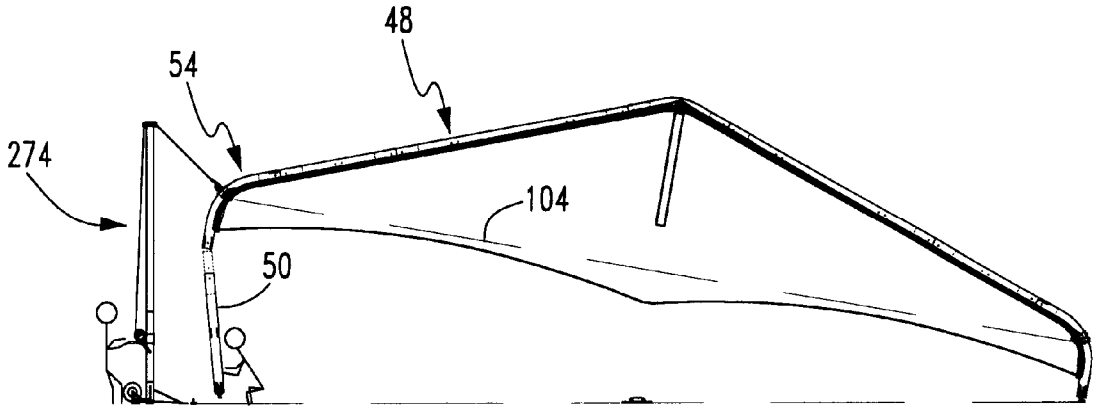
FIG. 36 is a front elevational illustration of the installation of a leg at a first side of a roof portion.

With reference now to FIG. 36, the first sides of the roof portions 48 are raised further to allow insertion of the legs 50. Preferably, two people are positioned at each roof portion 48. One person operates the jack 274 while the other person connects the leg 50 to the eave 54. The leg 50 is connected to the eave 54 by sliding the insert 294 of the leg 50 into the lower end of the eave 54 so that the buttons 296 are aligned with the openings 126. The buttons 296 engage the openings 126 to lock the leg 50 to the eave 54.

After the upper ends of the legs 50 have been connected to the eaves 54, the lower ends of the legs 50 are connected to the base members 22. The pivot plates 116 of the base inserts 110, which extend from the lower ends of the legs 50, desirably are positioned at the interior sides of the pivot plates 26 of the base members 22. It may be necessary to draw the legs 50 inwardly by pulling on the legs 50 or the assembly cables 104 in order to bring the legs 50 into position. The openings 124 in the pivot plates 116 of the base inserts 110 are aligned with the openings 28 in the pivot plates 26 of the base members 22. The legs 50 are then secured to the base members 22 by passing the bolts 130, 138 of the shackles 132, 140 through the aligned openings 28, 124 in the pivot plates 26, 116.

Figure 37:
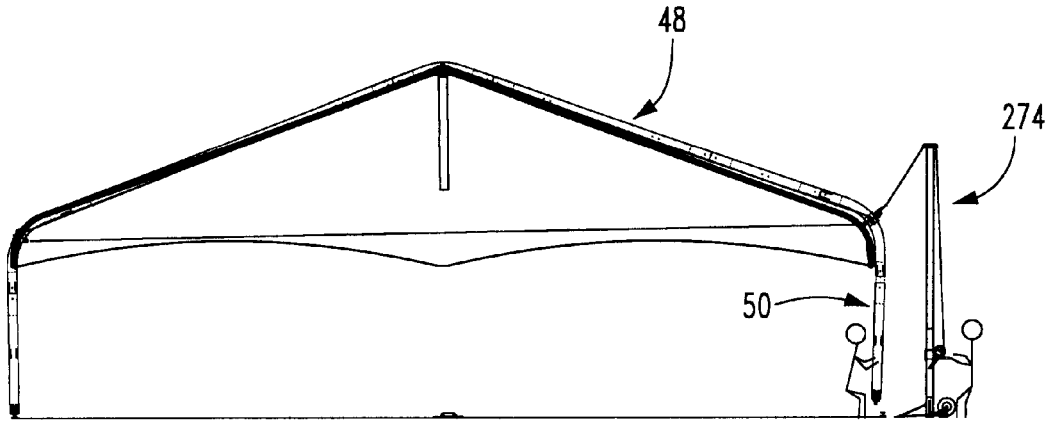
FIG. 37 is a front elevational illustration of the installation of a leg at a second side of a roof portion.

With reference to FIG. 37, the legs 50 are installed at the second sides of the roof portions 48 in the same manner. The second sides of the roof portions 48 are disconnected from their associated base members 22 and raised using the jacks 274. The base inserts 110 are then removed from the eaves 54 of the roof portions 48 and inserted into the lower ends of the legs 50. The second sides of the roof portions 48 are raised further to allow connection of the upper ends of the legs 50 to the lower ends of the eaves 54. The lower ends of the legs 50 are then secured to the base members 22 with the shackles 132, 140.

Figure 38:
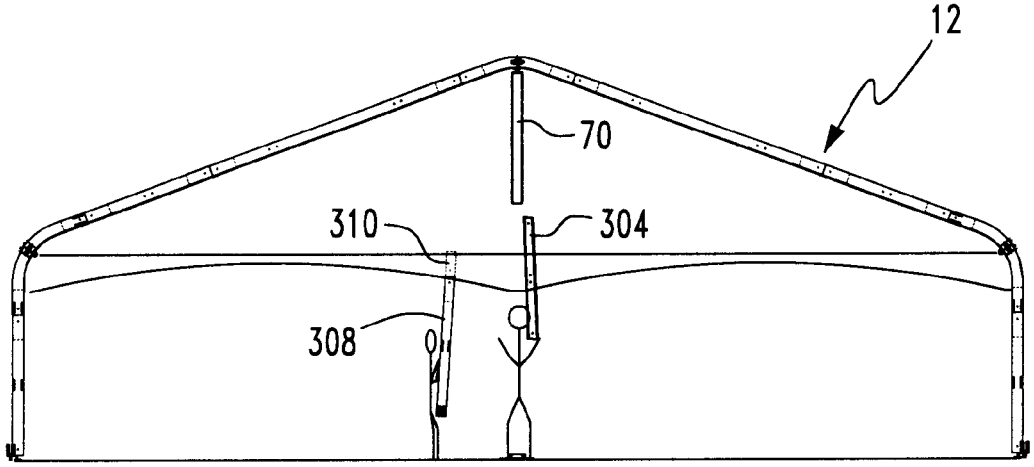
FIG. 38 is a front elevational illustration of the installation of an end column and end leg of the tent.

With reference to FIG. 38, an end column 304 desirably is connected to the top insert 70 at each of the end beam assemblies 12. Preferably, a first person slides an upper end of the end column 304 over the top insert 70 and pulls a lower end of the end column 304 inwardly towards the interior of the tent 10. A second person connects an end leg assembly 308 to the end column 304 by sliding an insert 310 of the leg assembly 308 into the lower end of the end column 304. A pair of retractable buttons (not shown) extend from the insert 310 of the leg assembly 308 and engage a pair of openings (not shown) in the lower end of the end column 304 to lock the leg assembly 308 to the end column 304.

Figure 39:
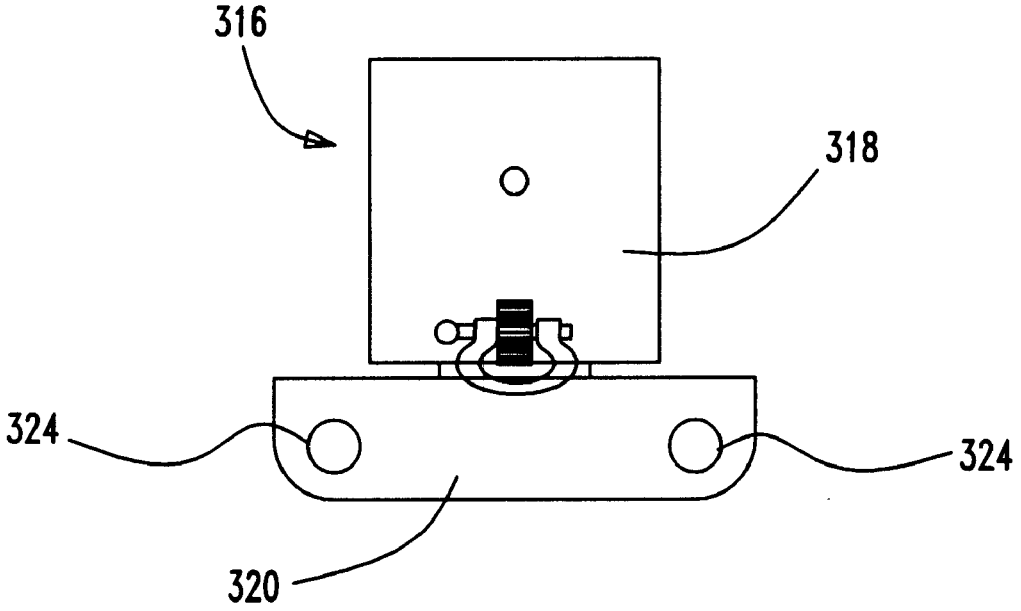
FIG. 39 is a front elevational view of an end base insert of the tent.

An end base insert 316 is connected to each of the end leg assemblies 308. As illustrated in FIG. 39, each of the end base inserts 316 comprises an insert portion 318 and a pivot plate 320 at an end of the insert portion 318. An opening 324 is provided through each side of the pivot plate 320. The end base inserts 316 preferably are positioned at the interior sides of the pivot plates 26 of the end base members 26 and connected to the base members 26 with first and second shackles 132, 140.

Figure 40:
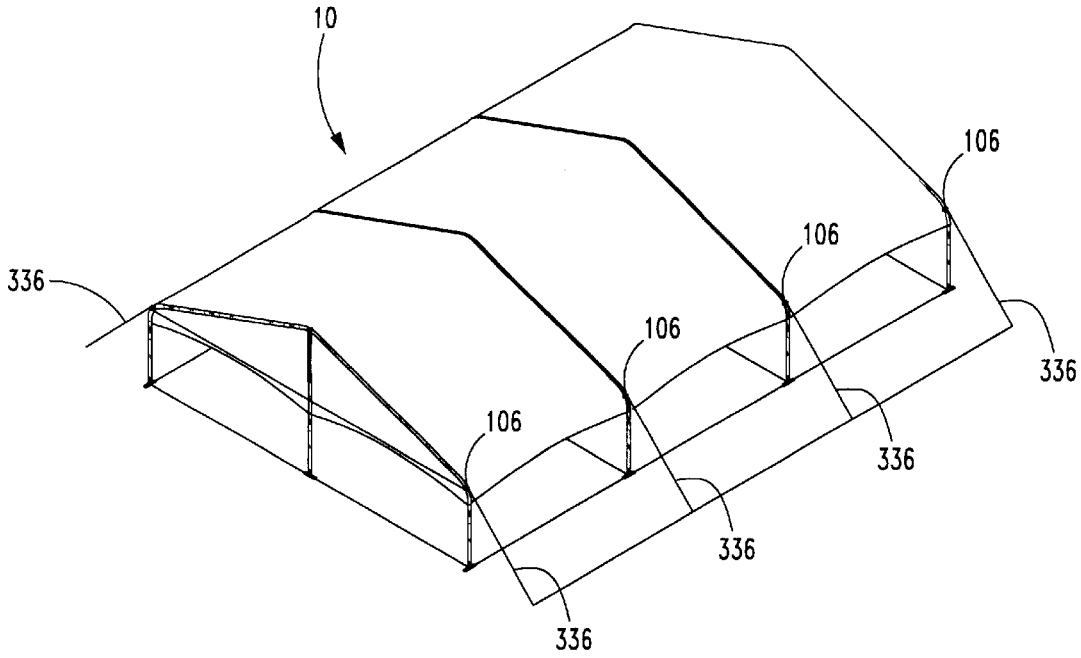
FIG. 40 is a perspective view of the tent with high wind guys installed.

With reference now to FIG. 40, high wind guys 336 may next be installed, if desired, in order to reinforce the tent 10 against high winds. The high wind guys 336 preferably are connected to the brackets 106 at the eaves 54 of the beam assemblies 12 and extend downwardly from the eaves 54 to the ground surface at approximately a 45 degree angle. An opening (not shown) desirably is provided in the beam covers 268 at each of the eaves 54 for access to the brackets 106. Each of the high wind guys 336 desirably includes a ratchet assembly (not shown). The high wind guys 336 are staked to the ground and tensioned evenly using the ratchet assemblies.

Figure 41:
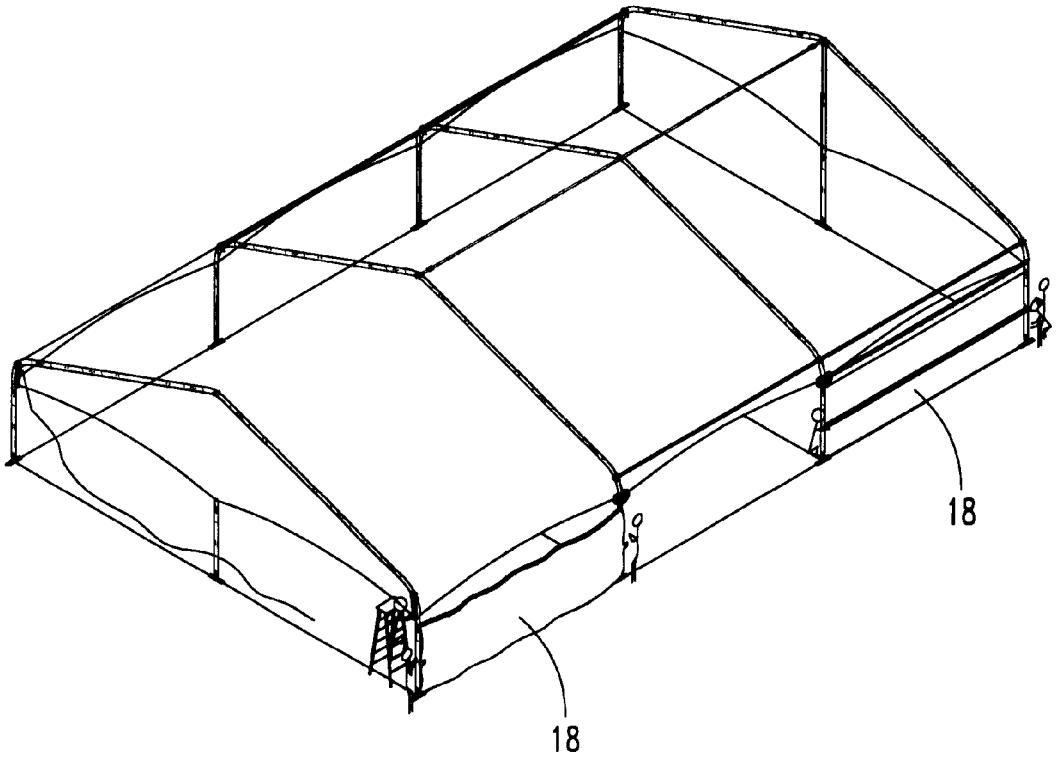
FIG. 41 is a perspective illustration of the installation of the wall panels.

With reference to FIG. 41, the wall panels 18 of the tent 10 preferably are installed next. The keders 168 of the wall panels 18 are fed into the outer keder tracks 162 of the beam assemblies 12. A keder track flare 340 (see FIG. 35) desirably is provided at each of the legs 50 for insertion of the keders 168. The wall panels 18 are fed upwardly through the keder tracks 162 from the keder track flares 340.

Figure 42:
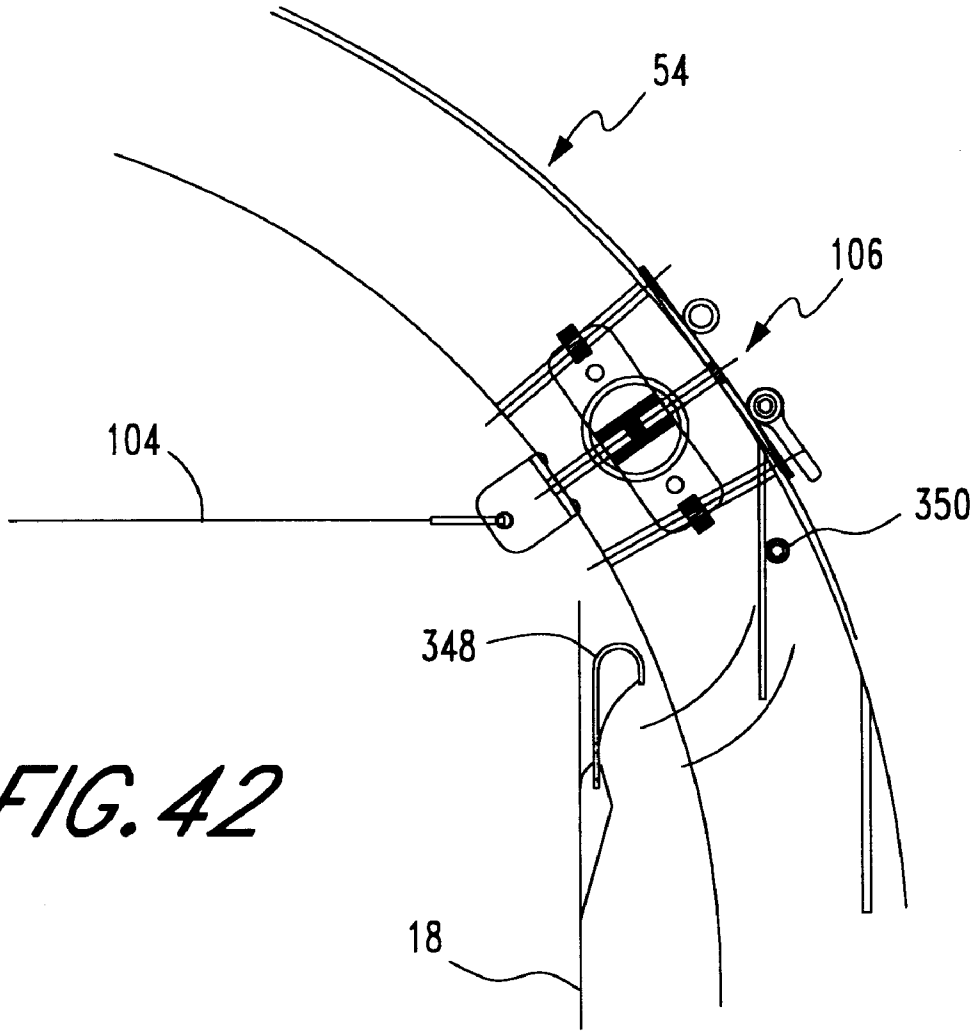
FIG. 42 is a front elevational illustration of the connection of a wall panel to a top panel.

Each of the wall panels 18 preferably includes a number of snap fixtures 348 along an upper end thereof, as illustrated in FIG. 42. The snaps fixtures 348 are connected to a snap line 350 that extends along a lower end of each of the top panels 14 to attach the wall panel 18 to the top panel 14. A buckle strap (not shown) is further provided at each of the upper comers of the wall panels 18. The buckle straps preferably are attached to the brackets 106 at the eaves 54 of the beam assemblies 12.

The lower ends of the wall panels 18 are fed downwardly through the keder tracks 162 of the legs 50 from the keder track flares 340. A buckle strap (not shown) also is provided at each of the lower comers of the wall panels 18. The wall panels 18 preferably are attached to the base members 22 by looping the buckle straps through the shackles 132, 140 at the base members 22.

Figure 43:
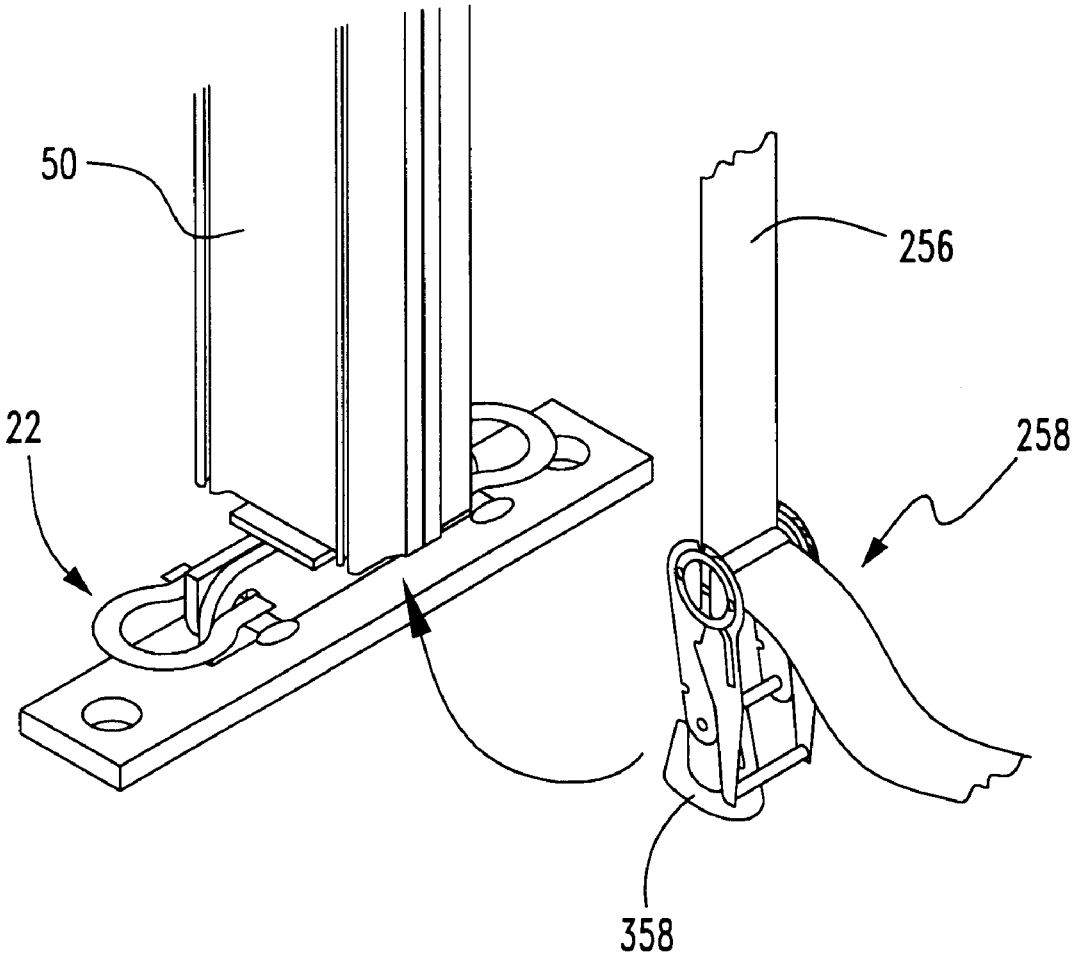
FIG. 43 is a perspective illustration of the connection of a tensioning strap to a beam assembly of the tent.

The top panels 14 and end panels 16 are tensioned using the side and comer tensioners 220, 230. With reference to FIG. 43, a pair of hooks 358 are provided at the second ends of each of the tensioning straps 256. The tensioning straps 256 are attached to the legs 50 by placing the hooks 358 around the lower ends of the legs 50. By operating the ratchet assemblies 258, the tensioners 220, 230 are pulled downwardly by the tensioning straps 256 to tension the panels 14, 16. Preferably, the ratchet assemblies 256 at opposite sides of each of the beam assemblies 12 are operated in unison to tension the panels 14, 16 evenly.

Figure 44:
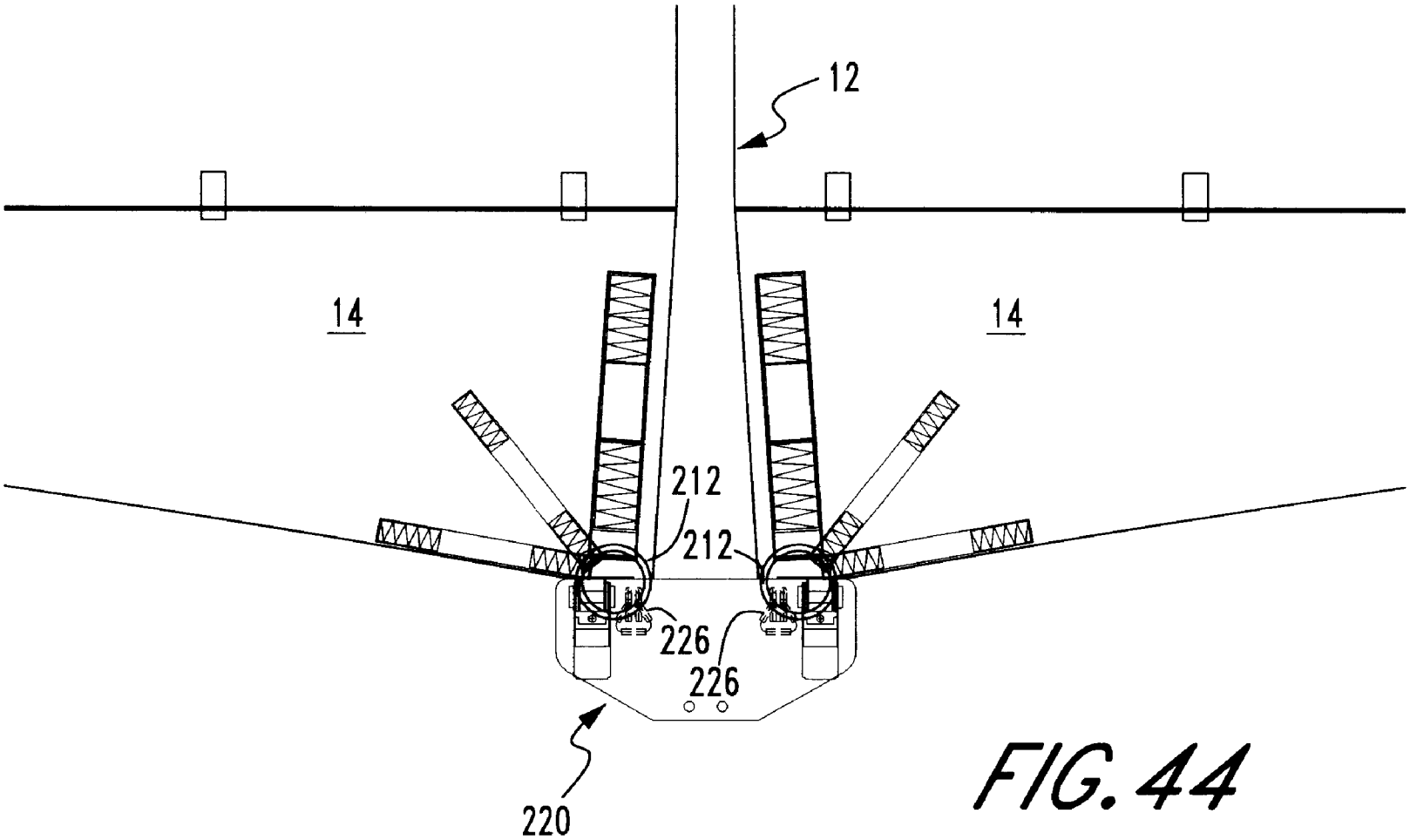
FIG. 44 is a front elevational view of a side tensioner installed at an interior beam assembly.

As illustrated in FIG. 44, the hooks 226 extending from the rear of the tensioners 220 are preferably closer together than the rings 212 of adjacent top panels 14. Thus, when the tensioner 220 is attached to the panels 14 and pulled downwardly by the tensioning strap 256, the corners of the panels 14 are pulled both inwardly towards the beam assembly 12 and downwardly towards the base member 22. This tensions the panels 14 both longitudinally along the length of the beam assemblies 12, and laterally between the beam assemblies 12. The arch-shaped ends of the top panels 14 resist bunching and wrinkling as the panels 14 are tensioned.

Figure 45:
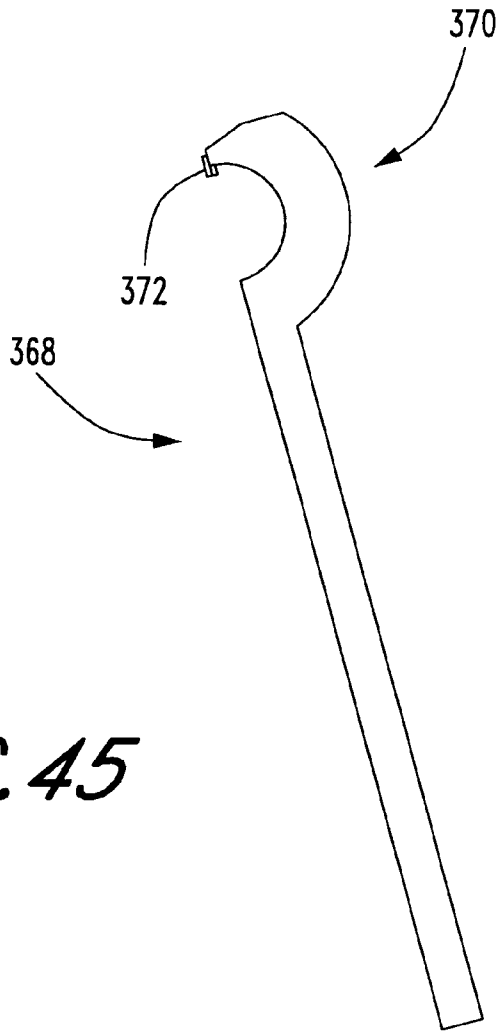
FIG. 45 is a front elevational view of a wrench for adjusting a length of a lower purlin of the tent

The top panels 14 and wall panels 18 preferably are further tensioned by adjusting the length of the lower purlins 146 that extend between adjacent beam assemblies 12. Referring again to FIG. 26, a plurality of holes 364 are provided around the circumference of the first cam 192 of each of the lower purlins 146. With reference to FIG. 45, a wrench 368 desirably is provided for rotating the first cam 192. In the illustrated embodiment, the wrench 368 has a hooked end portion 370 having a pin 372 at an end thereof. The wrench 368 is placed over the first cam 192 so that the pin 372 resides in one of the holes 364 and the end portion 370 rests against the surface of the first cam 192. By turning the wrench 368, the first cam 192 is rotated with respect to the second cam 194 so that the peak 202 of the cam surface 198 of the first cam 192 is aligned with the peak 202 of the cam surface 198 of the second cam 194. The overall length of the purlin 146 is thereby increased. As the length of the lower purlin 146 is increased, the top panel 14 and wall panels 18 extending between the beam assemblies 12 are further tensioned.

Finally, the beam covers 268 are tensioned using the ratchet assemblies 224, 238 at the front of the tensioners 220, 230. The high wind guys 336, if installed, can also be further tensioned using the ratchet assemblies thereof.

Because the tent 10 of the illustrated embodiment is anchored to the ground at the base members 22 during construction thereof, the risk of damage to the tent 10 or injury to persons nearby during construction of the tent 10 is reduced. The tensioning of the top panels 14, end panels 16, and wall panels 18 improves the overall appearance of the tent 10 and reduces noise and frame stresses caused by the flapping of the panels 14, 16, 18 in the wind.

The tent 10 is easily erected by unskilled workers with minimal specialized equipment. In addition, the tent 10 comprises a number of relatively small frame components that can easily be transported from site to site. For a 5,000 square foot tent of the illustrated embodiment, the disassembled shipping volume is approximately 480 cubic feet. In contrast, a typical 5,000 square foot fabric-covered structure would have a shipping volume of approximately 1280 cubic feet. The tent of the illustrated embodiment is thus well-suited for short-term rental for parties and other gatherings.

Figure 46:
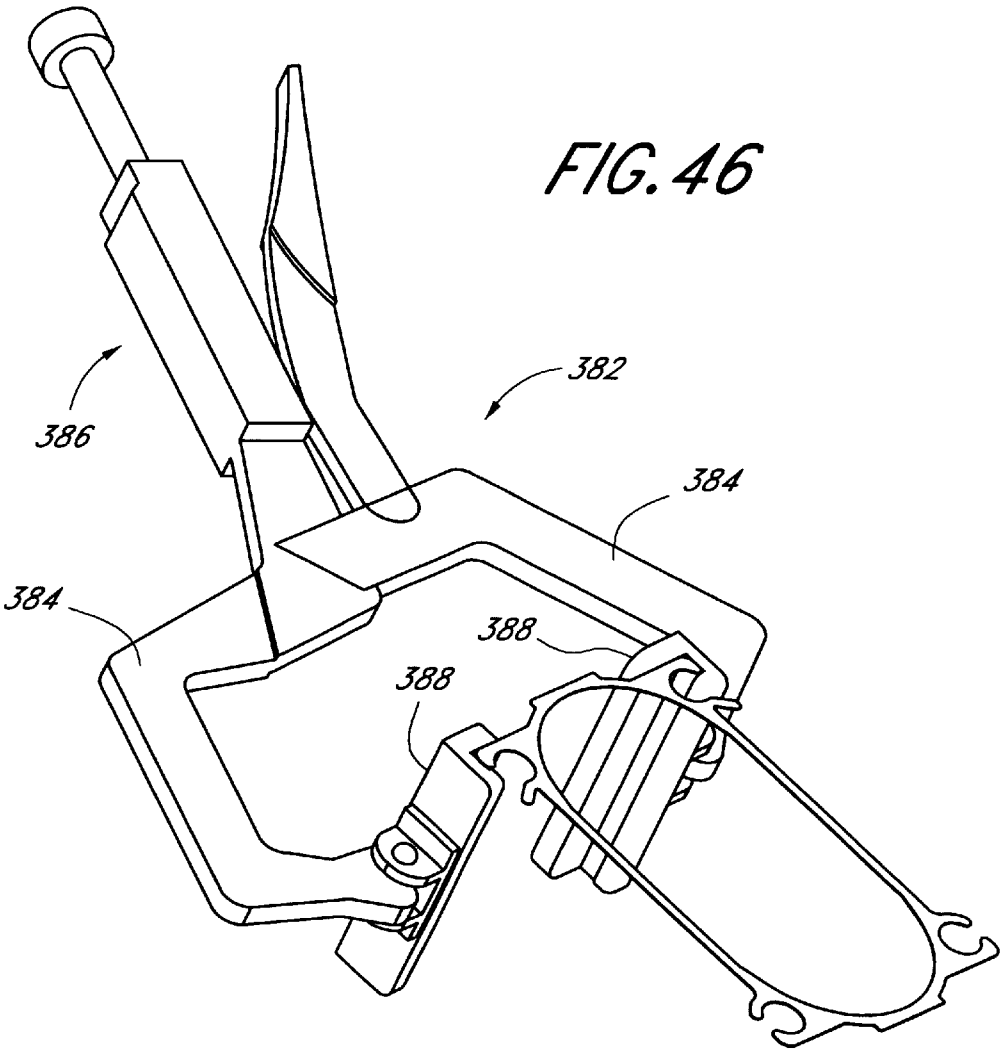
FIG. 46 is a schematic illustration of a feeder clamp.
Figure 47:
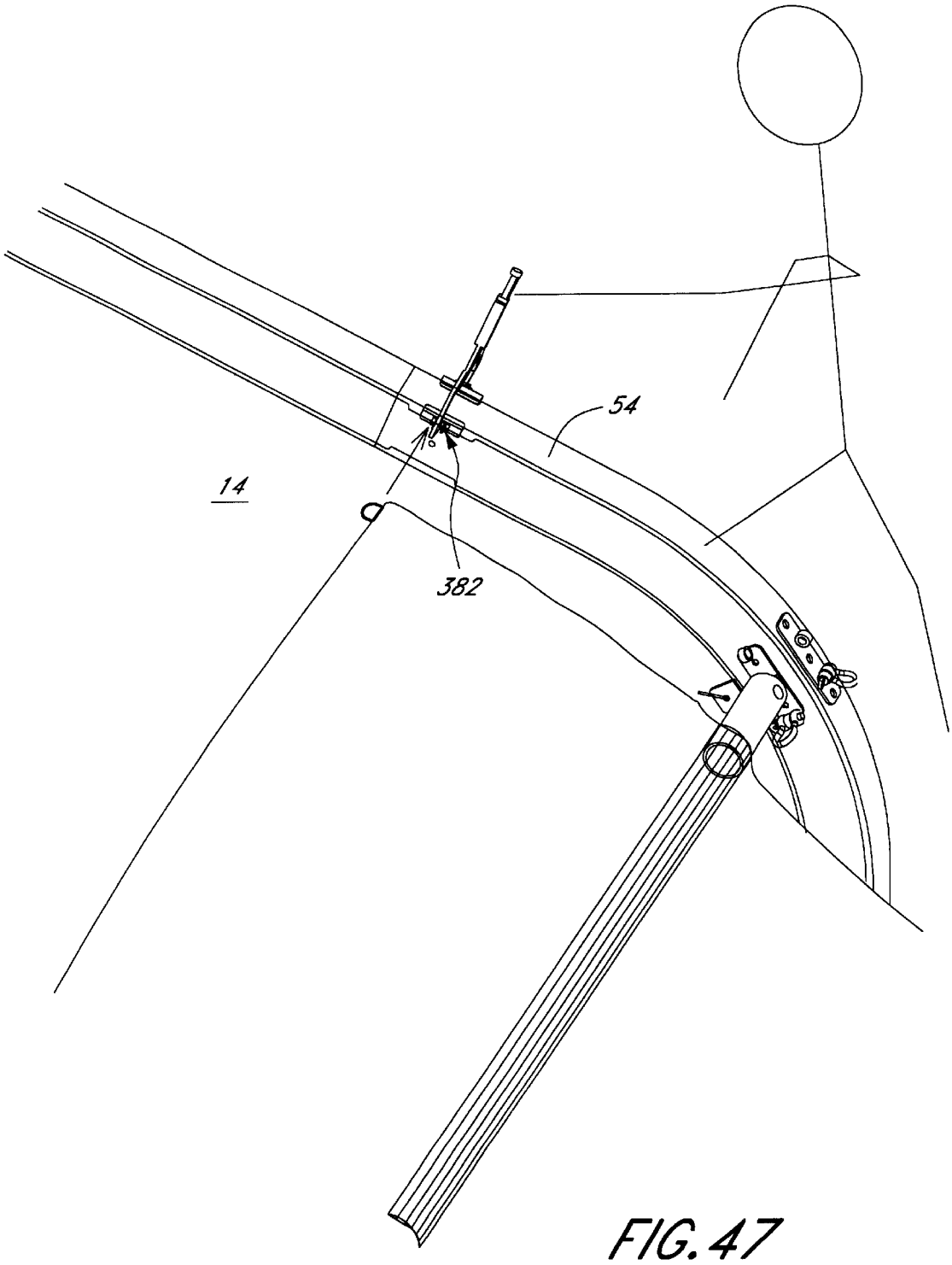
FIG. 47 is an environmental perspective view of the feeder clamp illustrating its use in installing one of the top panels.

With reference now to FIGS. 46 and 47, a feeder clamp 382 is shown. In the illustrated embodiment, the feeder clamp 382 comprises a pair of arms 384 connected to a vise grip-type handle 386. A guide member 386 is pivotally connected to an end of each arm 384.

The feeder clamp 382 can optionally be used to facilitate installation of the top panels 14 of the tent 10. As before, the keders 168 of the top panel 14 are first fed into the keder track flares 166 at the eaves 54 of the beam assemblies 12. Preferably, the keders 168 are fed through the keder tracks 164 approximately 18-24 inches. A feeder clamp 382 is then clamped to each of the eaves 54 at the keder track flares 166 so that the guide members 386 cover the upper, flared portions of the keder track flares 166. This prevents the keders 168 from catching and bunching at the keder track flares 166 as the top panels 14 are pulled through the keder tracks 164.

The keders 168 of the top panel 14 can be pulled through the keder tracks 164 from the other side of the tent 10 by two people using the ropes 178. Because an additional two people are not required to attend the keder track flares 166 as the top panels 14 are pulled through the keder tracks 164, the number of people required to install the top panels 14 is reduced from four to two.

Although the invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof Thus, it is intended that the scope of the present invention herein disclosed should not be limited by the particular disclosed embodiments described above, but should be determined only by a fair reading of the claims that follow.

What is claimed is:

1. A method of erecting a tent comprising two or more beam assemblies, each of said beam assemblies comprising a roof portion and a pair of legs for supporting said roof portion, the method comprising the steps of:

securing base members to the ground at predetermined locations;

connecting said roof portions to said base members;

lifting said roof portions upwardly from the ground while maintaining the connection to said base members;

disconnecting a first side of each of said roof portions from an associated one of said base members;

raising said first side above said base member;

connecting a first leg to said first side;

connecting said first leg to said base member;

disconnecting a second side of each of said roof portions from an associated one of said base members;

raising said second side above said base member;

connecting a second leg to said second side; and connecting said second leg to said base member.

2. The method of claim 1, wherein said first sides of said roof portions are raised substantially in unison by attaching a jack to a plurality of said roof portions at said first sides, and said second sides are raised substantially in unison by attaching a jack to a plurality of said roof portions at said second sides.

3. The method of claim 2, wherein said first sides of said roof portions are raised substantially in unison by attaching a jack to each of said roof portions at said first sides, and said second sides are raised substantially in unison by attaching a jack to each of said roof portions at said second sides.

4. The method of claim 1, further comprising installing a panel of web material between adjacent ones of said roof portions prior to disconnecting said first sides of said roof portions from said base members.

5. The method of claim 4, wherein each of said roof portions comprises a curved eave at each of said first and second sides, and a curved apex connected between said eaves, and said panel is installed by feeding a keder portion of said panel into a track formed along each of said roof portions and pulling said panel over said apexes from one of said eaves to the other.

6. The method of claim 5, further comprising attaching an adjustable-length purlin between adjacent ones of said roof portions prior to installing said panel, and increasing a length of said purlin after said panel is installed to apply tension to said panel.

7. The method of claim 6, wherein the length of said purlin is adjusted by turning a first cam associated with a first portion of said purlin relative to a second cam associated with a second portion of said purlin.

8. The method of claim 1, further comprising:

installing a first panel of web material between a first of said beam assemblies and a second of said beam assemblies by feeding a keder portion of said first panel into a keder track formed in each of said first and second beam assemblies;

installing a second panel of web material between said second beam assembly and a third of said beam assemblies by feeding a keder portion of said second panel into a keder track formed in each of said second and third beam assemblies; and tensioning both of said first and second panels using a tensioner connected to said first and second panels and to said second beam assembly or associated base member.

9. The method of claim 8, wherein said first and second panels are tensioned simultaneously.

10. The method of claim 8, wherein said tensioner pulls said first and second panels inwardly towards said second beam assembly and downwardly towards said base member.

11. A method of erecting a tent comprising two or more longitudinally spaced, transversely extending beam assemblies, each of said beam assemblies comprising a roof portion and a pair of legs for supporting said roof portion, the method comprising the steps of:

securing base members to the ground;

connecting said roof portions to said base members;

rotating said roof portions upwardly from the ground about a generally transverse axis;

disconnecting said roof portions from said base members;

rotating said roof portions about a generally longitudinal axis; and installing said legs beneath said roof portions.

12. The method of claim 11, wherein said roof portions are rotated about said longitudinal axis in a first direction to install said legs at a first side of said tent, and in a second opposite direction to install said legs at a second side of said tent.

13. The method of claim 11, wherein a retractable button extends from an end of each of said legs, and said legs are installed by inserting said ends of said legs into said roof portions to engage said buttons in corresponding openings in said roof portions.

14. The method of claim 13, wherein the length of said purlin is increased by turning a first cam associated with a first portion of said purlin relative to a second cam associated with a second portion of said purlin.

15. The method of claim 14, wherein said attaching of said tensioner to said first and second panels comprises placing a pair of hooks extending from said tensioner through a pair of rings attached to said first and second panels.

16. The method of claim 14, further comprising attaching said tensioner to said second beam assembly or associated base member with a tensioning strap, said tensioning strap having a ratchet assembly associated therewith.

17. The method of claim 15, wherein said pulling comprises operating said ratchet assembly of said tensioning strap to shorten a length of said tensioning strap and thereby pull said tensioner towards said base member.

18. A method of installing a panel of web material between two beam assemblies of a tent, comprising the steps of:

attaching an adjustable-length purlin between said beam assemblies;

feeding a keder of said panel through a keder track formed in each of said beam assemblies; and increasing a length of said purlin to increase a distance between said beam assemblies and thereby tension said panel.

19. A method of installing panels of web material between beam assemblies of a tent, said beam assemblies being anchored to the ground at a number of base members, the method comprising the steps of:

installing a first panel between a first beam assembly and a second beam assembly by feeding a keder portion of said first panel into a keder track formed along each of said first and second beam assemblies;

installing a second panel between said second beam assembly and a third beam assembly by feeding a keder portion of said second panel into a keder track formed along each of said second and third beam assemblies;

attaching a tensioner to said first and second panels; and pulling said first and second panels inwardly towards said second beam assembly and downwardly towards an associated one of said base members with said tensioner.

* * * * *